US005653585A

United States Patent [19]

Fresco

[11] Patent Number: 5,653,585

[45] Date of Patent: Aug. 5, 1997

[54] APPARATUS AND METHODS FOR COOLING AND SEALING ROTARY HELICAL SCREW COMPRESSORS

[76] Inventor: Anthony N. Fresco, P.O. Box 734, Upton, N.Y. 11973

[21] Appl. No.: 323,584

[22] Filed: Oct. 17, 1994

Related U.S. Application Data

[63] Continuation-in-part of Ser. No. 2,980, Jan. 11, 1993, abandoned.

[51] Int. Cl.[6] ..... F25B 43/02

[52] U.S. Cl. ..... 418/100; 418/85; 418/94; 418/99

[58] Field of Search ..... 418/1, 85, 91, 418/94, 99, 100, 197; 55/38, 48, 51; 184/6.16, 6.24, 6.26

[56] References Cited

U.S. PATENT DOCUMENTS

| | | | |
|---|---|---|---|
| 2,516,507 | 7/1950 | Deming | 55/38 |
| 3,138,320 | 6/1964 | Schibbye | 418/99 |
| 3,265,293 | 8/1966 | Schibbye | 418/100 |
| 3,557,687 | 1/1971 | Grinpress et al. | 418/94 |
| 3,814,557 | 6/1974 | Volz | 418/197 |
| 3,820,923 | 6/1974 | Zweitel | 418/99 |
| 4,080,119 | 3/1978 | Eriksson | 418/100 |
| 4,242,067 | 12/1980 | Segerstrom | 418/197 |
| 4,483,697 | 11/1984 | Deysson et al. | 55/38 |
| 4,497,185 | 2/1985 | Shaw | 418/99 |
| 4,773,837 | 9/1988 | Shimomura et al. | 418/197 |

FOREIGN PATENT DOCUMENTS

| | | | |
|---|---|---|---|
| 0643525 | 6/1962 | Canada . | |
| 2621303 | 11/1976 | Germany . | |
| 2947479 | 5/1981 | Germany | 418/100 |
| 0892024 | 12/1981 | U.S.S.R. | 418/94 |

OTHER PUBLICATIONS

McKellar, M.G. and Tree, D.R., "Efficiency Study of Oil Cooling of a Screw Compressor," Purdue University, W. Lafayette, IN, Report No. 0561-1 HL89-7, Apr. 1989.

Tree, D.R., McKellar, M.G., and Fresco, A.N., "Efficiency Study of Oil Cooling of a Screw Compressor," Proceedings of the 1990 USNC/11R-Purdue Refrigeration Conference and the 1990 ASHRAE-Purdue CFC Conference, pp. 110-119, Jul. 17-20, 1992.

*Primary Examiner*—Charles G. Freay

[57] ABSTRACT

In a compression system which incorporates a rotary helical screw compressor, and for any type of gas or refrigerant, the working liquid oil is atomized through nozzles suspended in, and parallel to, the suction gas flow, or alternatively the nozzles are mounted on the suction piping. In either case, the aim is to create positively a homogeneous mixture of oil droplets to maximize the effectiveness of the working liquid oil in improving the isothermal and volumetric efficiencies. The oil stream to be atomized may first be degassed at compressor discharge pressure by heating within a pressure vessel and recovering the energy added by using the outgoing oil stream to heat the incoming oil stream. The stripped gas is typically returned to the compressor discharge flow. In the preferred case, the compressor rotors both contain a hollow cavity through which working liquid oil is injected into channels along the edges of the rotors, thereby forming a continuous and positive seal between the rotor edges and the compressor casing. In the alternative method, working liquid oil is injected either in the same direction as the rotor rotation or counter to rotor rotation through channels in the compressor casing which are tangential to the rotor edges and parallel to the rotor centerlines or alternatively the channel paths coincide with the helical path of the rotor edges.

27 Claims, 7 Drawing Sheets

102
98
96
100
104
106
110
112
116
94
108
114
120, 122
12
124
10
92
2A
48
12
36
158
44
22
46
42
M
91
24
87
50
12
38
40
92
26
2A
28
78
20
76
84
86
82
138
148
150
80
142
140
152
146
134
144
136
132
130
156
154
14
0
54
56
HOT OIL
52
60
62
34
64
66
EVAPORATOR, 18
58
32
30
CONDENSER, 16
EXPANSION VALVE

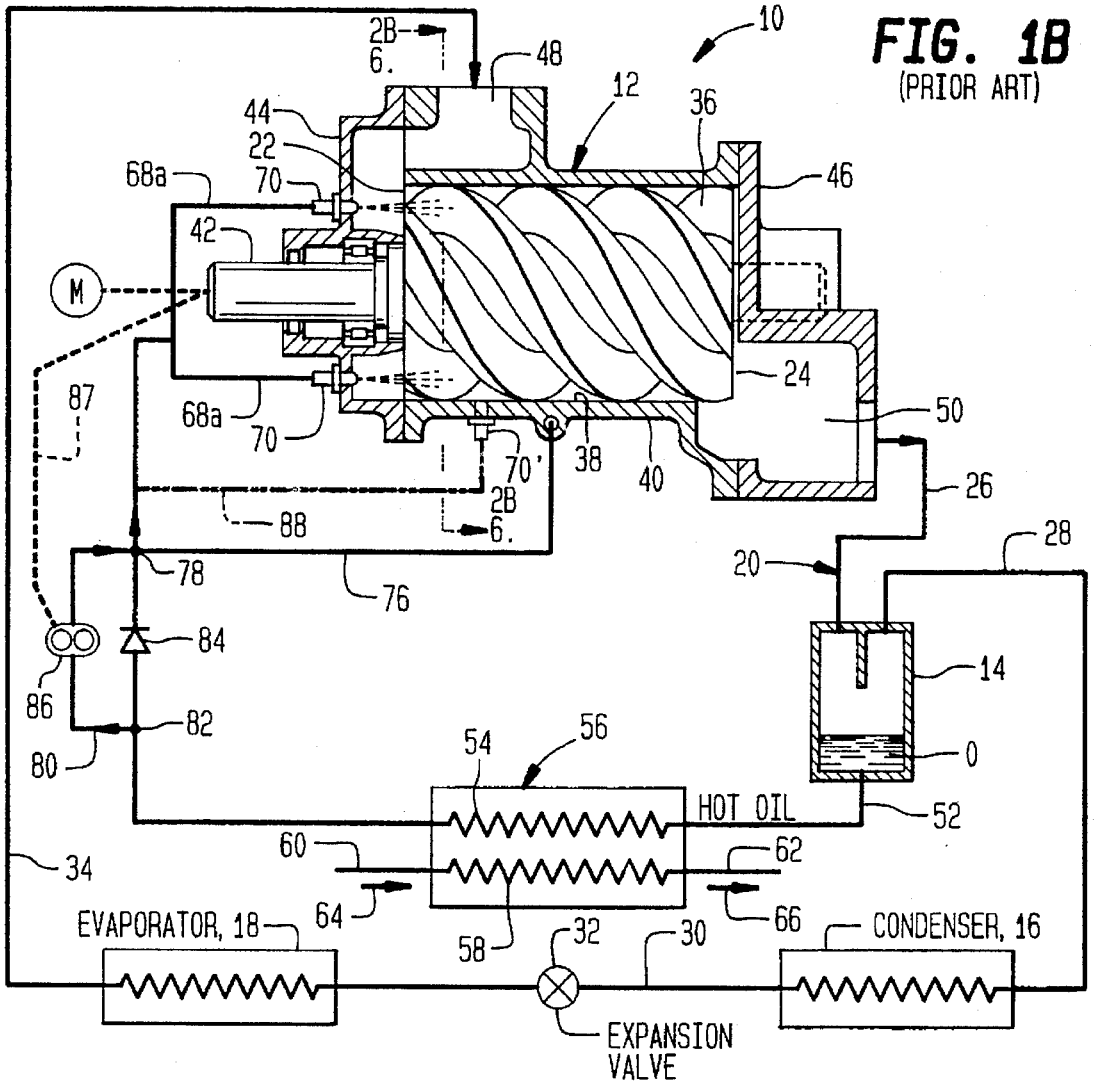
FIG. 1B
(PRIOR ART)
FIG. 2B
(PRIOR ART)
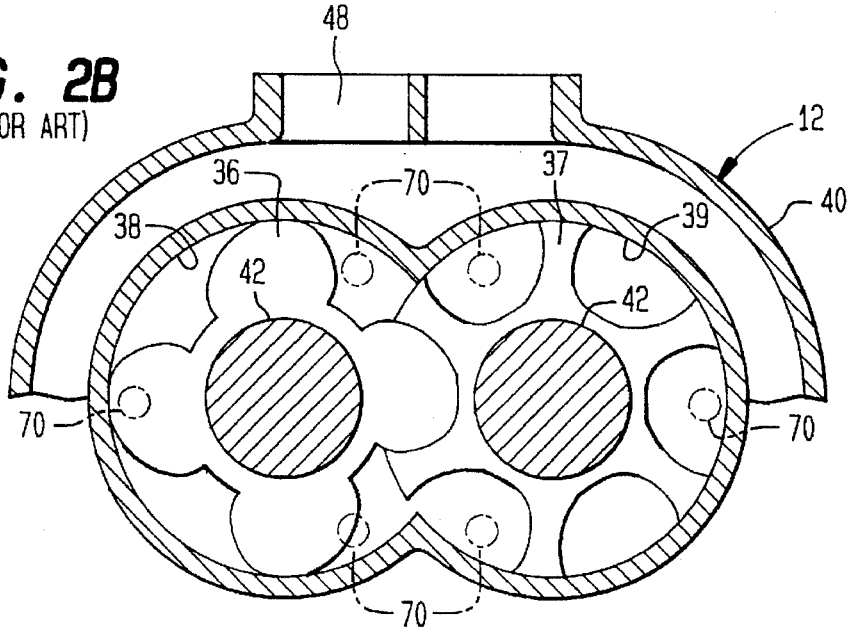

FIG. 2A
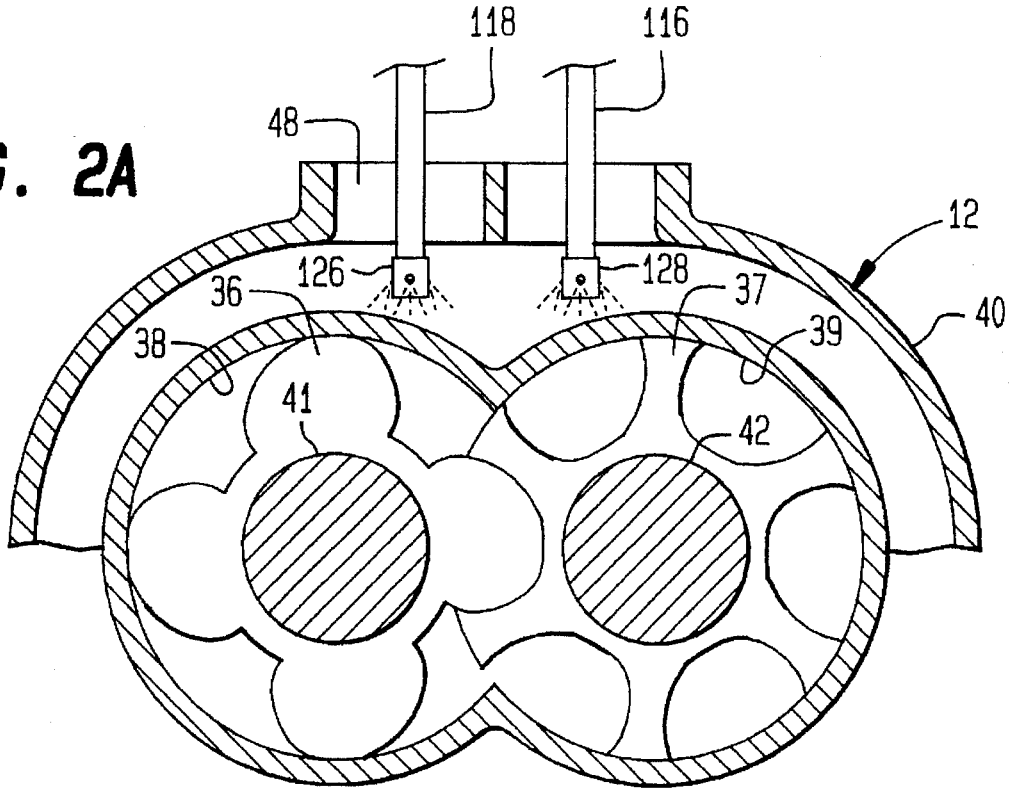
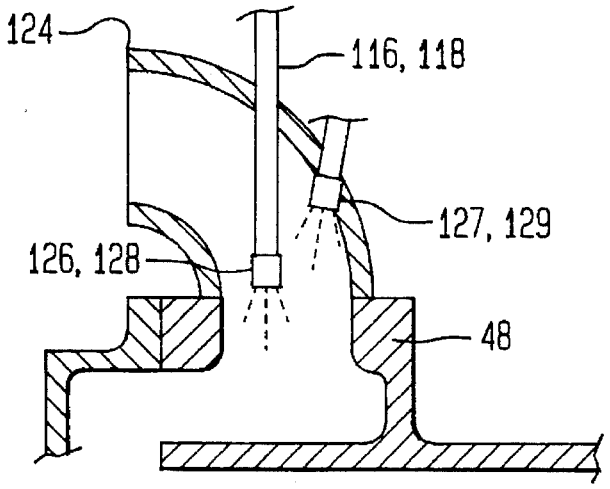
FIG. 3

FIG. 6
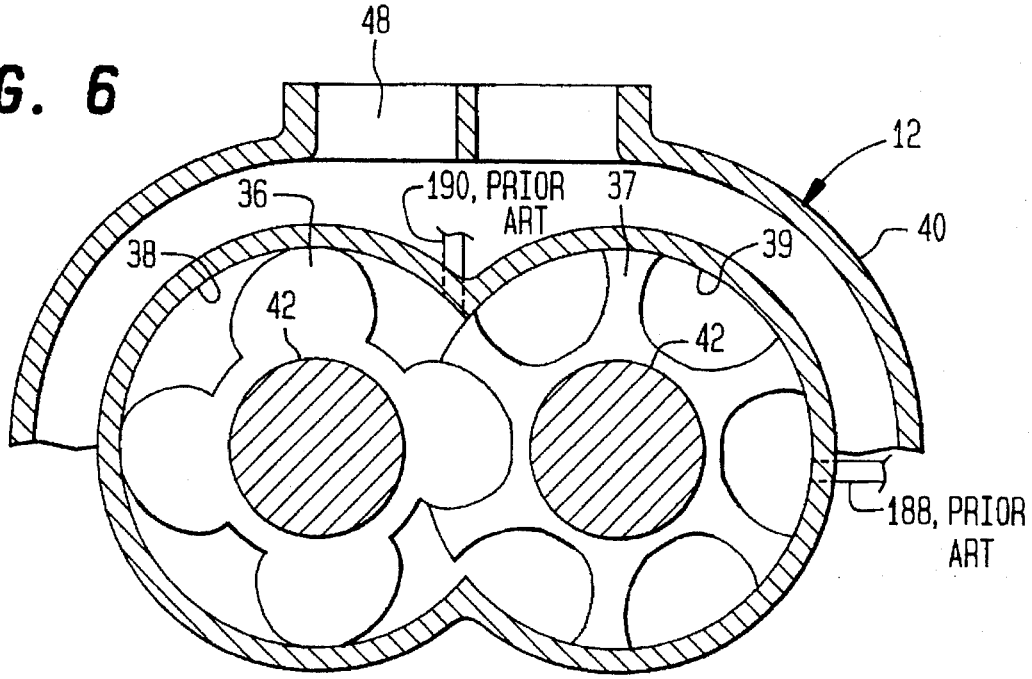
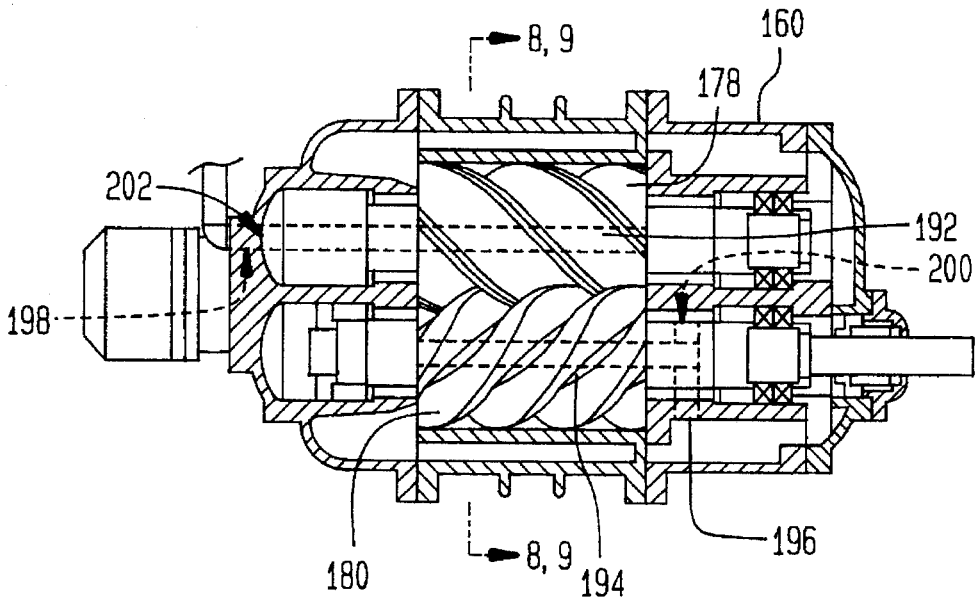
FIG. 7

APPARATUS AND METHODS FOR COOLING AND SEALING ROTARY HELICAL SCREW COMPRESSORS

CROSS REFERENCE TO RELATED APPLICATIONS

This is a continuation-in-part of application Ser. No. 08/002,980, filed Jan. 11, 1993, which is now abandoned.

CONTRACTUAL ORIGIN OF THE INVENTION

The United States Government has rights in this invention pursuant to Contract DE-AC02-76CHO0016 W(I)-83-040, CHO330, between the U.S. Department of Energy and Associated Universities, Inc., Upton, N.Y. 11973-5000.

BACKGROUND OF THE INVENTION

This invention concerns an improved apparatus and methods for cooling and sealing the compressed gas in a rotary helical screw compressor using any type of gas, whether or not the gas is highly superheated at suction pressure conditions, and whether or not the gas is highly soluble in the compressor oil, to optimize the effectiveness of the compressor oil in both cooling the gas and sealing the rotor edges and to maximize both the isothermal and volumetric efficiencies of the gas compression process. As noted in the prior art, a lubricating fluid such as a hydrocarbon oil is incorporated within and circulated through a refrigeration or gas compression circuit utilizing a helical screw rotary compressor to compress the working fluid. The lubricating oil performs multiple functions, one of which is to lubricate the moving parts of the compressor, such as the bearings and seals. The same oil is also used to seal the compression chamber defined by the moving parts, i.e., the intermeshed helical screw rotors within the casing bores during their rotation, and at the same time it is used to cool the working fluid. The compression raises the temperature of the working fluid, so that both the working fluid itself and the lubricating oil must be cooled upon discharge from the compression chamber. Conventionally, oil that is miscible with the refrigerant or mixed with the gas is discharged with the working fluid at a high pressure from the compressor, is separated from the working fluid in an oil separator, and returned to the compressor. Typically, the oil is cooled within an oil cooler and is pressurized by an oil pump prior to injection into the compressor via one or more injection ports opening to the compression process itself. The injection port for the oil intended for sealing is typically the very same one used to inject the oil intended for cooling so that there is no distinction between the location of the injection port or ports for the oil used for cooling the gas or sealing the clearance spaces or lubricating the rotors. In the case of refrigerant gases, oftentimes, to eliminate the oil cooler, refrigerant in liquid form is diverted from the refrigeration cycle and injected via one or more ports either opening to the compression process itself near the discharge end of the rotors or, following the compression process, opening to the discharge port of the compressor. In either case, the temperature of the gas and oil mixture at the discharge of the compressor is lowered to the level equivalent to that obtained by the separate oil cooler, the oil cooler being cooled typically either by liquid refrigerant diverted from the refrigeration cycle or by water. The injection of liquid refrigerant to the compression process itself is referred to in the industry as Liquid Injection.

As far back as 1962, Nilsson and Wahlsten proposed, in Canadian patent 643,525, to improve the cooling of the working fluid by providing the liquid, typically a lubricating oil but possibly other liquids such as water, in very finely divided form through a series of holes at various locations in the compressor casing. Such holes were shown distributed along the upper cusp of the compressor casing and also in the suction port area in close proximity to the suction side ends of the rotors. The holes in the suction port area direct the liquid along the axis of rotation of the rotors and face the suction side ends of the rotors. They also proposed that the rotors themselves be made hollow and therefore capable of conducting the liquid out through atomizing holes that lead directly into the gas compression pockets formed by the intermeshing of the male and female rotors.

In 1966, in U.S. Pat. No. 3,265,293, Schibbye disclosed a rotary screw compressor acting as a vacuum pump in which, as he noted is old in the art, liquid is introduced into the working space of the compressor to aid in sealing the running clearance spaces and for directly cooling the contents of the compression chambers to reduce the temperature rise thereof as the work of compression is done thereon. Schibbye illustrates the introduction of such liquid by a supply pipe delivering a spray of liquid into the compressor intake. The end of the supply pipe is suspended within the suction intake. The liquid is introduced solely through the supply pipe and for the dual purpose of sealing the running clearance spaces and directly cooling the contents of the compression chambers. Schibbye noted also that it will be understood that other and equivalent means for introducing liquid into the compressor, such as that disclosed by Nilsson and Wahlsten in U.S. Pat. No. 3,129,877, may be employed.

A design similar to that of Nilsson and Wahlsten in Canadian Patent 643,525, showing nozzles in the suction port area in close proximity to the suction side ends of the rotors, the nozzles mounted in the compressor casing, was presented by Shaw in 1985 in U.S. Pat. No. 4,497,185. In this design, all of the oil intended for cooling and sealing the working fluid is atomized at the end plates of the compressor on the suction side. The nozzles themselves are mounted in the compressor casing facing the inlet end of the intermeshed helical screw rotors. An alternative location is presented wherein the nozzles are mounted on the compressor casing perpendicular to the rotor axes at a point just after the gas or refrigerant suction charge is locked in the rotors at a closed thread. This alternative is proposed when the gas or refrigerant is highly soluble in the oil.

In 1974, Zweifel, in U.S. Pat. No. 3,820,923, disclosed an apparatus whereby oil is atomized and injected through approximately 100 very small holes drilled in the compressor casing circumferentially around near the discharge end of the rotors.

It is of interest to note that Nilsson and Wahlsten, in U.S. Pat. No. 3,129,877, which was issued in 1964, state that it is highly desirable that compression be commenced without preheating of the inlet air and that by confining the introduction of liquid to or approximately to the compression phase of the cycle, undesirable preheating of the inlet air by recirculated liquid at higher than inlet temperature is with certainty avoided.

For simplicity in disclosing the present invention, the lubricating oil or other liquid such as water or refrigerant in liquid form which is used for lubrication or sealing or cooling will be referred to as the nonworking liquid. The compressed gas, vapor or refrigerant will be referred to as the working fluid.

There are two disadvantages to the atomization process when the working fluid is a refrigerant such as R-12 or R-22 that is highly soluble in the nonworking liquid, i.e., the injection of atomized oil at the suction port at a temperature in the range of 50° C. into the working fluid that may be as cold as −35° C. could cause heating and expansion of the working fluid prior to entering the compression chamber. Furthermore, the injection into the working fluid at the suction port of atomized oil from the discharge side of the oil separator sump could liberate significant quantities of dissolved working fluid into the suction side prior to entering the compression chamber defined by the rotors and casing of the compressor. In both cases, the volumetric efficiency of the compression would decrease.

In addition, depending upon the geometrical relationship of the suction port to the rotors, mounting the nozzles within the compressor casing, as specified in the prior art, can cause the nonworking liquid oil flow to be transverse to the working fluid gas flow, thereby diminishing the probability of a homogeneous mixture entering the compression chamber and increasing the tendency for the oil droplets to accumulate on the inner surfaces of the suction intake port of the compressor.

Most attempts to improve the efficiency of the rotary screw compressor have been oriented towards improving the effectiveness of the oil injection system. However, it is also possible to improve compressor efficiency by providing more than two rotors within the same casing, therein reducing the volume of the clearance space between the tips of the rotors and the compressor casing with respect to the volumetric flow rate capacity of the compressor. However, in the prior art, disclosures of screw compressors in which the casing houses more than two rotors do not indicate any attempt at reducing the volume of the clearance space between the tips of the rotors and the compressor casing with respect to the volumetric flow rate capacity of the compressor.

For example, in 1963, Bailey, in U.S. Pat. No. 3,073,513, indicates as an objective to provide a rotary compressor of the positive displacement type including two or more rotors disposed within a housing and formed with intermeshing helical lobes and grooves, which, however, are not in physical contact with one another, but engage with small clearances, in which a liquid is introduced into the compressor in sufficient amounts to seal the clearances and also to enable one rotor to drive the other or others without the necessity for the usual intermeshing timing gears hitherto employed. However, no further spatial relationship between the rotors is described other than to show the conventional single male and single female intermeshing rotors.

In 1964, in U.S. Pat. No. 3,133,695, Zimmern introduced what is known in the industry as the "Monoscrew" compressor, but which actually consists of three rotors within the same housing. In the center is an hourglass-shaped screw rotor which is flanked by two intersecting "gate" or worm gear rotors whose axes of rotation are perpendicular to the central hourglass rotor. This type of compressor is considered in the art to be a totally separate category of rotary screw compressor, and therefore is not germane to the objective of reducing the volume of the rotor to casing clearance space with respect to the volumetric flow rate capacity of the dual screw compressor.

In 1976, in Federal Republic of Germany Patent P26 21 303.6-15, Maekawa disclosed a screw compressor unit in which two axially adjacent sets of rotatable screws are mounted within the same housing, the first rotors and the second rotors being coaxially interconnectable via first and second shafts. In effect, this compressor consists of two sets of male and female intermeshing screw rotors within a single housing, the sets of rotors being longitudinally separated by the first and second shafts. Again, there is no attempt at reducing the volume of the clearance space between the tips of the rotors and the compressor casing with respect to the volumetric flow rate capacity of the compressor.

SUMMARY OF THE INVENTION

It is the object of the present invention to present simpler and more effective means for cooling and sealing of the working fluid within the compression chamber which allow the maximum possible levels of isothermal and volumetric efficiencies regardless of the type of refrigerant or gas or vapor working fluid being compressed. Such methods of cooling and sealing enable the compressor performance to approach the characteristics of an ideal rotary screw compressor.

It is an object of the invention therefore that the working fluid entering the rotors at the suction intake of the compressor should contain a homogeneous mixture of finely atomized nonworking liquid oil droplets. The inherent cooling of the working fluid during the compression process by the nonworking liquid oil droplets reduces the specific volume of the working fluid within the compressor, thereby minimizing the back leakage across the rotor profile edges and hence improving the volumetric efficiency. This also allows the compression to match more closely isothermal conditions.

It is a further object of the invention that the clearance space between the rotor tips or profile edges and the casing of the compressor should be positively and directly sealed by a thin film of nonworking liquid oil, using a minimum of said nonworking liquid oil, similar to the action of the piston rings in a reciprocating compressor. This maximizes the volumetric efficiency regardless of the precision or design of the rotors, and the nonworking liquid oil which is used primarily for sealing purposes then also provides cooling of the working fluid precisely at the point of the intermeshing of the rotors when the working fluid is being compressed. Such sealing and cooling also then minimize the decline in both isothermal and volumetric efficiencies as the pressure ratio increases, which is characteristic of the prior art. Such sealing and cooling also improve the application of the rotary helical screw compressor for cases where low speed operation is desirable, such as automotive air-conditioning.

It is a further object of the invention that the cooling stream of nonworking liquid oil which is atomized and the sealing stream of nonworking liquid oil which remains in liquid form should be injected at separate locations. This is to allow differences in temperature, and hence viscosity, between the cooling and sealing oil streams so that the cooling and sealing functions can be optimized nearly independently.

It is still a further object of the present invention to configure the means for atomization of nonworking liquid oil to minimize the time and space available for the working fluid gases dissolved in the nonworking liquid to be liberated, and also to minimize any temperature increase in the working fluid gas in the suction port of the compressor. Furthermore, differences in the nozzle direction can significantly improve the homogeneity of the gas-oil droplet mixture entering the suction port of the compressor.

Similarly, a further object of the present invention for cases where the temperature of the working fluid at the suction port is greater than the temperature of the nonworking liquid is to configure the means for atomization of the nonworking liquid to maximize the cooling of the working fluid by the nonworking liquid prior to entry into the suction end of the rotors.

Another object of the present invention is to present a means for degassing the cooling stream of nonworking liquid oil for those conditions where it would be advantageous to do so typically in conjunction with the means for atomization presented herein.

Finally, it is the object of this invention to present an apparatus which increases the isothermal and volumetric efficiencies of the compressor by reducing the volume of the clearance space between the tips of the rotors and the compressor casing with respect to the volumetric flow rate capacity of the compressor, therein achieving economy of scale by permitting a single male rotor to intermesh with a plurality of female rotors within the same compressor casing. The resulting increase in isothermal and volumetric efficiencies of the compressor is a synergistic effect, in that the efficiencies of the improved apparatus are greater than would be achieved by a plurality of dual screw compressors yielding the equivalent volumetric flow rate capacity under the same operating conditions.

In particular, the invention comprises an apparatus and methods for improving the isothermal or volumetric efficiency of a gas or vapor or refrigerant working fluid compression system typically of the type including a helical screw compressor for compressing a gas or vapor or refrigerant working fluid. The compressor comprises a compressor casing including parallel side-to-side intersecting bores, intermeshed helical screw rotors mounted within the bores for rotation about the screw rotor axes and defining a compression chamber therebetween, the rotors having tips, the tips extending along the rotors in a helical path, the tips and the casing defining a clearance space therebetween, means defining a low pressure suction port and high pressure discharge port within the compressor opening to the intermeshed helical screw rotors and to the compression chamber, means for feeding a low pressure suction gas or vapor or refrigerant working fluid to the suction port for compression within the compression chamber, and means for supplying a nonworking liquid such as oil at a pressure higher than compression suction pressure, means for injecting part of the nonworking liquid at a pressure higher than compression suction pressure, and means for separating the gas or vapor or refrigerant working fluid and the nonworking liquid, the means for separating the gas or vapor or refrigerant working fluid and the nonworking liquid communicating with the high pressure discharge port of the compressor, the means for separating the gas or vapor or refrigerant working fluid and the nonworking liquid having a means for discharging the gas or vapor or refrigerant working fluid and a means for discharging the nonworking liquid.

The methods for improving the isothermal or volumetric efficiency of the compression system comprise the steps of injecting in bulk form part of the nonworking liquid at a pressure higher than compression suction pressure into the compression chamber and to the clearance space between the casing and any tip of any of the rotors, and atomizing through a nozzle another part of the nonworking liquid at a pressure higher than compression suction pressure, the nozzle directing the atomized nonworking liquid into the gas or vapor or refrigerant working fluid, wherein the nozzle is suspended within the low pressure suction port or is suspended within the means for supplying the gas or vapor or refrigerant working fluid to the low pressure suction port, or is carried by the means for supplying a gas or vapor or refrigerant working fluid to the low pressure suction port.

The nozzle or a plurality of nozzles directs the flow of atomized droplets of the nonworking liquid oil in a direction which results in the flow of atomized droplets being either essentially parallel to or coincident with the centerline of the suction gas flow as to further result in a homogeneous mixture of atomized nonworking liquid oil droplets within the gas or vapor or refrigerant working fluid within the suction port prior to entering the rotors of the compressor for compression. The nozzles may be suspended within the compressor casing within the suction port or outside the compressor within the suction pipe, or mounted on the compressor suction pipe, the proper location being determined by the particular application. For gas or vapor or refrigerant working fluids which are highly soluble in the nonworking liquid, locating the nozzles at a point in close proximity to the compressor rotors within the compressor casing limits the time and space available for the dissolved gas or vapor or refrigerant working fluid to be liberated from the nonworking liquid oil and limits the transfer of heat from the oil to the gas, yet at the same time allows for a homogeneous mixture of gas or refrigerant and the oil droplets.

Mounting of the nozzles on piping contained within the compressor suction piping or intake port provides for greater flexibility in optimizing for different applications, including retrofitting to existing installations, and allows the oil flow to be parallel to the gas flow thereby creating a homogeneous mixture. It is also important to note that in the current invention, the cooling oil flow rate, which is then atomized, is a small percentage, generally 5–25% of the injection oil flow rate conventionally used. This in itself is a further means for limiting both the heating of the suction gas and the liberation of dissolved gas into the suction intake. However, to work effectively with conventional oil injection methods, the flow rate of the conventional oil injection should be significantly reduced, e.g. in the range of 50% of the conventionally recommended flow rate, in order to minimize interference with the atomized oil droplets by the liquid oil injected within the rotor spaces. In cases where the refrigerant or gas is highly soluble in the oil, reducing the conventional injection oil flow rate assists in degassing the oil by providing a greater settling time within the oil separator sump for the dissolved and entrained gas to bubble out of the oil and join with the gas discharge flow to the load. Reducing the oil injection flow rate also reduces the percentage of oil by volume in the discharge flow mixture. In the prior art, although the percentage of oil by volume in the suction flow is relatively small, i.e. approximately 1%, the percentage of oil in the discharge flow can be in the range of 10% or greater, depending on the operating conditions. Such a large percentage of oil causes a proportional decrease in the volumetric efficiency.

The current invention does not rely on the atomized cooling oil flow alone to provide the sealing effect. Provision of sealing oil flow, whether as conventionally done in the prior art by injection through the slide valve or through a hole in the casing either on the female rotor side approximately one and one-half threads along the rotors from the suction port or on the male rotor side near the upper cusp, or through the sealing means to be presented further by this invention, is an important means for maintaining the overall performance of the compressor, with respect to both the isothermal and the volumetric efficiencies.

Specifically, the step of injecting in bulk form part of the nonworking liquid at a pressure higher than compression suction pressure into the compression chamber and to the clearance space between the casing and any tip of any of the rotors is most preferably achieved by any of the rotors of the compressor containing an internal passage, the internal passage communicating with the means for supplying the nonworking liquid at a pressure higher than compression suction pressure, any tip of any of the rotors containing a channel in the helical path of the tip of the rotor, the channel opening to the clearance space, the internal passage communicating with the channel, and injecting the part of the nonworking liquid in bulk form through the internal passage to the channel in the helical path at any tip of any of the rotors.

Two preferred ways to achieve the direct positive sealing of the clearance between the rotors and compressor casing are disclosed herein. That is, to maximize the sealing of the clearance between the rotor edges and the casing, in the desired apparatus the rotors contain hollow inner cavities which are supplied nonworking liquid, at a pressure ranging to higher than compressor discharge pressure, through one or more holes in the rotor shafts. The nonworking liquid oil is injected into the hollow inner cavities of the rotors through entrance holes provided in the rotor shaft ends in the bearing area or through holes in the area of the seals. However, instead of ejecting the oil in an atomized form into the gas space, as per the Nilsson and Wahlsten apparatus, in the present invention, the nonworking liquid oil is ejected in liquid form through channels or grooves contained in the rotor tips or edges. The channels extend in a helical path along the rotor tips or edges. Where necessary for the particular compressor design to prevent the oil from flowing out of the compressor space and into the suction and discharge port areas, the channels may be sealed at the extreme ends of the rotors. The result is that a sealing film of oil is created exactly where it is most effective, i.e. directly at the rotor tips or edges. A further advantage over the Nilsson and Wahlsten apparatus is that when the male and female rotors intermesh and compress the gas, liquid oil which can also perform a cooling function is injected directly from the channels into the rotor compression space so that the cooling effectiveness of the atomization is enhanced. In addition, the oil entering the compression space would enter at a nearly constant temperature whether or not the oil enters the suction or discharge area, and the total amount of oil in the compression space would cumulatively increase from suction to discharge improving the overall cooling effectiveness and minimizing the liberation of dissolved gas at the suction end of the rotors.

The step of injecting in bulk form part of the nonworking liquid at a pressure higher than compression suction pressure into the compression chamber and to the clearance space between the casing and any tip of any of the rotors alternatively is achieved by the compressor casing having a channel, the channel opening to any of the bores of the casing, the channel communicating with the means for supplying the nonworking liquid at a pressure higher than compression suction pressure, and injecting the part of the nonworking liquid in bulk form through the channel in the casing.

The apparatus referenced previously for improving the isothermal or volumetric efficiency of the compression system comprises the compressor casing having a channel, or preferably a plurality of channels, communicating the nonworking liquid to the clearance space between the casing and any tip of any of the rotors, the channel, or channels, directing the nonworking liquid in a direction essentially tangential to the tips of the rotors.

The channels extend in a direction parallel to, and along the length of, the rotors. Whenever necessary by the particular compressor design, the channels may be sealed in the casing corresponding to the extreme ends of the rotors so as to prevent said nonworking liquid from flowing out of the compression space and into the suction and discharge port areas.

Alternatively, the channels may follow a helical path in the compressor casing corresponding to the profile of the male and female rotors. Such a means ensures that the oil flowing out of the channels is always both tangential and perpendicular to the rotor edges so as to maximize the sealing effectiveness of the oil. Whenever necessary by the particular compressor design, the channels may be sealed in the casing corresponding to the extreme ends of the rotors so as to prevent the oil from flowing out of the compression space and into the suction and discharge port areas.

An alternate means for varying the oil flow rate applicable to said casing injection methods is to provide manually operated throttling valves in the oil supply lines to each individual hole or to suitable gangs of holes, such as one valve for the gang supplying the suction area, one for the center, and one for the discharge area, etc.

For any of the proposed sealing methods, when combined with atomization of the oil in the suction intake as proposed herein, optimum performance of the compressor can be achieved almost independently for cooling and sealing. Since the liquid oil injected through the casing or rotors of the present invention is now used almost exclusively for sealing, its temperature, and hence viscosity, can be varied independently of the atomized oil temperature. The total required oil flow for both rotor edge sealing and atomization is significantly less than current designs where the compressor is virtually flooded with oil. The present invention reduces the capital and operating cost and energy consumption required to pump and cool the oil. In applications where purity of the compressed gas is a paramount concern, such as in cryogenic processes, reduction in total required oil flow rate enhances the effectiveness of the oil removal equipment. Furthermore, since the sealing effectiveness has been maximized, it is possible to operate the compressor at reduced speed, i.e. in the range of 1000 RPM, without inducing significant efficiency losses. At such low speed operation, the potential application of the rotary screw compressor to uses such as automotive air conditioning is substantially increased.

As alluded to previously, in the current state of the art, injection of nonworking liquid into the compression chamber for cooling of the gas or vapor or refrigerant working fluid and to the clearance space between the casing and the tips of the rotors for sealing of the clearance space is conventionally performed exclusively by injection of nonworking liquid in bulk form through the slide valve or through a hole in the casing. Therefore, although not providing as effective a means for sealing the clearance space between the tips of the rotors and the casing, the step of injecting in bulk form part of the nonworking liquid at a pressure higher than compression suction pressure into the compression chamber and to the clearance space between the casing and any tip of any of the rotors may be achieved by the casing of the compressor having a valve, the valve providing a means for returning any part of the gas or vapor or refrigerant working fluid from the compression chamber to the low pressure suction port, the valve having a longitudinal axis parallel to the longitudinal axis central to the bores, the valve containing an internal passage, the internal passage communicating with the means for supplying the nonworking liquid at a pressure higher than compression suction pressure, the internal passage opening to any of the bores of the casing, and injecting the nonworking liquid in bulk form through the internal passage in the valve opening to any of the bores of the casing.

Alternatively, the step of injecting in bulk form part of the nonworking liquid at a pressure higher than compression suction pressure into the compression chamber and to the clearance space between the casing and any tip of any of the rotors may be achieved by the casing of the compressor containing a hole, the hole opening to any of the bores of the casing, the hole in the casing communicating with the means for supplying the nonworking liquid at a pressure higher than compression suction pressure, and injecting the nonworking liquid in bulk form through the hole in the casing.

When for reasons such as space limitations it may be impractical to provide the additional piping external to the compressor to mount the nozzle or nozzles within the suction piping or low pressure suction port, althoughnot the preferred embodiment, an alternative method for improving the isothermal or volumetric efficiency of the compression system, the casing of the helical screw compressor having a valve, the valve providing a means for returning any part of the gas or vapor or refrigerant working fluid from the compression chamber to the low pressure suction port, the valve having a longitudinal axis parallel to the longitudinal axis central to the bores, the valve containing an internal passage, the internal passage communicating with means for supplying nonworking liquid at a pressure higher than compression suction pressure, the internal passage opening to any of the bores of the casing, comprises the steps of injecting in bulk form a part of the nonworking liquid at a pressure higher than compression suction pressure into the compression chamber and to the clearance space between the casing and any tip of any of the rotors by injecting the nonworking liquid in bulk form through the internal passage in the valve opening to any of the bores of the casing, and atomizing through a nozzle another part of the nonworking liquid at a pressure higher than compression suction pressure, the nozzle directing the atomized nonworking liquid into the gas or vapor or refrigerant working fluid, the nozzle carried by the low pressure suction port of the compressor.

Despite the degassing effect caused by reducing the total oil flow rate, i.e. by allowing more settling time for the oil in the oil separator sump, thereby allowing for greater bubbling out of the dissolved and entrained gas, in cases where the refrigerant of gas or vapor working fluid is highly soluble in the nonworking liquid oil, it may still be necessary to degas the nonworking liquid oil prior to atomization and injection into the suction intake of the compressor to minimize losses in volumetric and isothermal efficiencies. In such a case, the compression system additionally includes means for separating the gas or vapor or refrigerant working fluid and the nonworking liquid, the means for separating the gas or vapor or refrigerant working fluid and the nonworking liquid communicating with the high pressure discharge port of the compressor, the means for separating the gas or vapor or refrigerant working fluid and the nonworking liquid having a means for discharging the gas or vapor or refrigerant working fluid and having a means for discharging the nonworking liquid, the method comprising the steps of directing a part of the nonworking liquid to a pressure vessel, the part of the nonworking liquid originating from the means for discharging the nonworking liquid from the means for separating the gas or vapor or refrigerant working fluid and the nonworking liquid, and raising the temperature of the part of the nonworking liquid within the pressure vessel, and liberating any portion of gas or vapor or refrigerant working fluid dissolved in the part of the nonworking liquid, and discharging the now degassed part of the nonworking liquid from the pressure vessel, and atomizing the degassed part of the nonworking liquid, and directing the degassed part of the nonworking liquid now in atomized form to the low pressure suction port, and discharging the liberated gas or vapor or refrigerant working fluid from the pressure vessel, and directing the liberated gas or vapor or refrigerant working fluid to the means for discharging the gas or vapor or refrigerant working fluid from the means for separating the gas or vapor or refrigerant working fluid and the nonworking liquid.

In practical terms, the atomization oil flow is drawn through a means for cooling such as a counterflow heat exchanger and directed to a pressure vessel where its temperature is raised, by any convenient means such as an electric resistance heater contained within the pressure vessel and positioned in the oil, to liberate the dissolved gas. The effluent oil and gas are cooled by heating the incoming oil from the oil separator sump. The effluent oil is pumped to the atomization nozzles, while the effluent gas may be compressed and/or cooled as required prior to entering the gas discharge of the oil separator.

This degassing process may of course also be applied to the sealing oil flow if it is advantageous to do so. In that case, the compression system further includes means for injecting the nonworking liquid into the compression chamber and to the clearance space between the casing and any tip of any of the rotors, and the step of discharging the degassed part of the nonworking liquid from the pressure vessel is followed by injecting the degassed part of the nonworking liquid into the compression chamber and to the clearance space between the casing and any tip of any of the rotors through the means for injecting the nonworking liquid.

To achieve the objective of reducing the volume of the clearance space between the tips of the rotors and the compressor casing with respect to the volumetric flow rate capacity of the compressor, the invention comprises an apparatus for improving the isothermal or volumetric efficiency of a gas or vapor or refrigerant working fluid compression system typically of the type including a helical screw compressor for compressing a gas or vapor or refrigerant working fluid. The compressor comprises a compressor casing including parallel intersecting bores, intermeshed helical screw rotors mounted within the bores for rotation about the screw rotor axes and defining a compression chamber therebetween, the rotors having tips, the tips extending along the rotors in a helical path, the tips and the casing defining a clearance space therebetween, means defining a low pressure suction port and a high pressure discharge port within the compressor opening to the intermeshed helical screw rotors and to the compression chamber, and means for feeding a low pressure suction gas or vapor or refrigerant working fluid to the suction port for compression within the compression chamber, wherein the parallel intersecting bores of the compressor casing having as the rotors a male rotor common to, and located central to, a plurality of female rotors, each of the female rotors intermeshing with the common male rotor central to the female rotors, each of the rotors rotatably mounted within the bores for rotation about the axes.

BRIEF DESCRIPTION OF THE DRAWINGS

FIG. 1B is a schematic diagram of a closed loop refrigeration system showing the prior art with respect to location of atomization nozzles.

FIG. 2A is a transverse sectional view of the suction end of the helical screw compressor forming a component of the system of FIG. 1A about lines 2A—2A showing the preferred embodiments of the present invention with respect to the cooling method.

FIG. 2B is a transverse sectional view of the suction end of the helical screw compressor forming a component of the system of FIG. 1B about lines 2B—2B showing the prior art with respect to location of the atomization nozzles.

FIG. 3 is a cross-sectional view of the piping and casing of the helical screw compressor showing the atomization nozzles in an alternate position outside of the compressor casing at a suitable location within the suction elbow and alternatively mounted in the elbow at a suitable angle such as 45° to the gas flow.

FIG. 6 is a transverse sectional view of the suction end of the helical screw compressor forming a component of the system of FIG. 1B about lines 2B—2B but revised to show the prior art with respect to the liquid oil injection ports in the casing of said compressor for the case wherein said compressor contains a capacity control slide valve and the case wherein said slide valve is not provided.

FIG. 7 is a plan view of the compressor illustrated in FIG. 4 showing the prior art wherein both compressor rotors contain a hollow inner cavity which is supplied nonworking liquid oil through a suitable port such as at the main bearings.

DESCRIPTION OF THE PREFERRED EMBODIMENTS

Figure 1A:
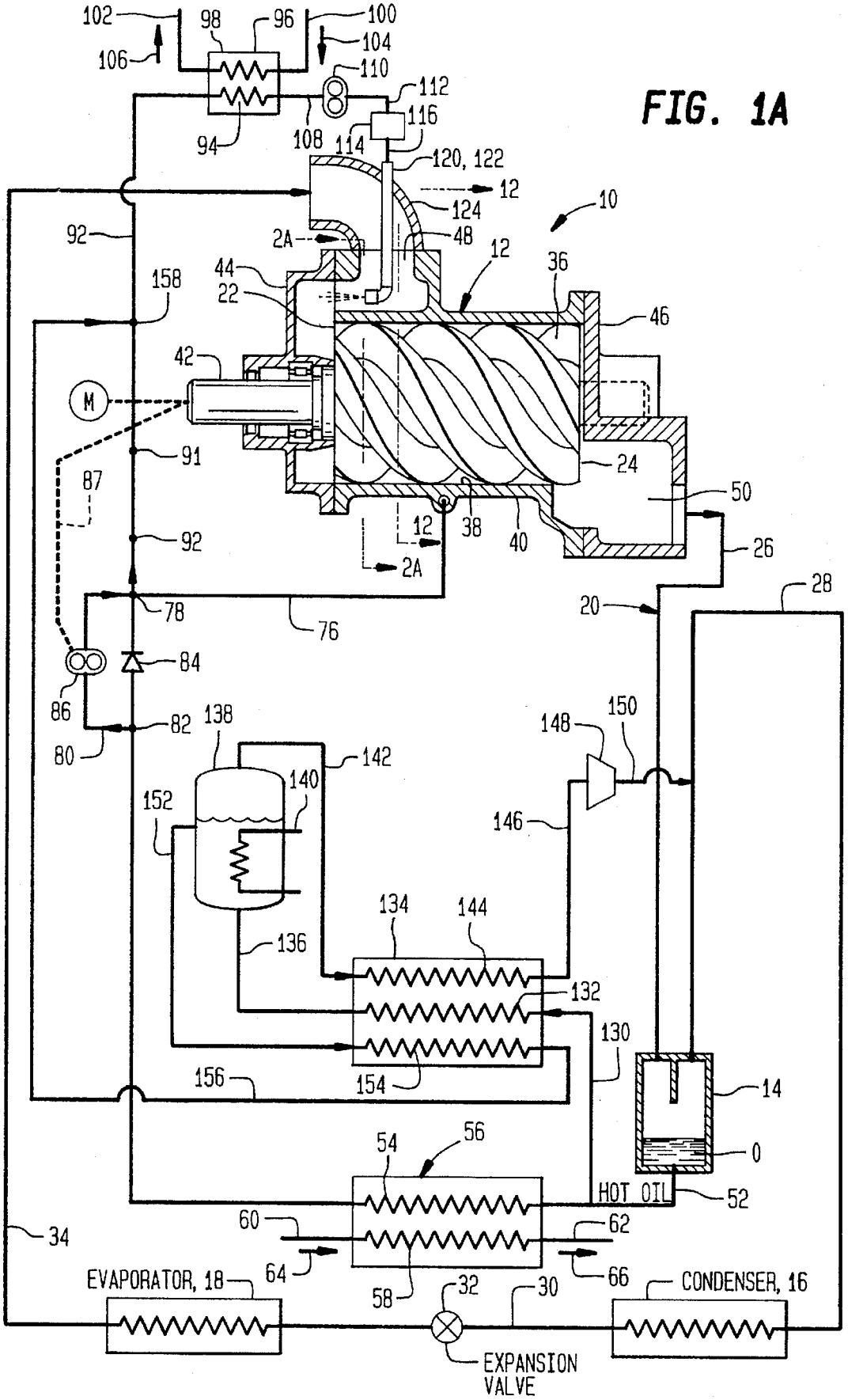
FIG. 1A is a schematic diagram of a closed loop refrigeration system showing the preferred embodiments of the present invention, including a method of the present invention for degassing the cooling oil prior to its atomization.

Referring to FIGS. 1A and 1B, as described in the prior art by Shaw, a refrigeration system is shown generally at 10 which includes as principal elements thereof a helical screw rotary compressor indicated generally at 12 and illustrated in longitudinal cross-section, an oil separator and sump 14, a condenser 16, and an evaporator 18, in series and in that order, connected in the closed loop by conduit means generally at 20. In that respect, compressor 12 conventionally comprises housing or casing 40, closed off at its ends by end walls 44,46, bearing an inlet or suction port 22, and an outlet or discharge port 24, respectively. Said housing or casing may contain a capacity control slide valve (not shown) wherein nonworking liquid oil may be injected into the compressor working space. The compressor discharge port 24 is connected via conduit 26 to the oil separator 14. Conduit 28 leads from the oil separator to the condenser 16. A further conduit 30 includes an expansion valve 32 which allows the expansion of the high pressure condensed refrigerant within the coil constituting the evaporator 18 for the system. A further conduit 34 returns the relatively low pressure refrigerant vapor back to the suction side of the compressor 12, entering the compression process by suction port 22.

The system illustrated in FIGS. 1A and 1B is typical of a closed loop compression and refrigeration process to which both the prior art and the present invention may be applied. The present invention has application also to compression systems and processes using rotary helical screw compressors for essentially any type of refrigerant, gas, or vapor.

Compressor 12 typically includes a pair of intermeshed helical screw rotors as at 36, 37, which are rotatably mounted within parallel intersecting bores 38, 39, of compressor casing 40. The rotors 36, 37, are mounted by shafts as at 42 for rotation about their axes. The bores are closed off at their ends by the end plates 44 and 46, through which project shafts 41, 42, as shown in FIGS. 2A and 2B. Portions of the compressor casing 40 and end plates as at 44, 46 define passages such as suction passage 48 leading to the compressor suction port 22 and discharge passage 50 to which conduit 26 is connected for supplying the compressed gas and entrained nonworking liquid lubricant oil to oil separator 14. The screw rotor ends are spaced from the end plates. A hot oil line 52 is connected to the bottom of the oil separator and sump 14 so as to receive separated oil 0 within the oil sump and pass it through a first heat exchange coil 54 within an oil cooler indicated generally as 56. The oil cooler 56 carries a second coil 58 through which a cooling medium is circulated by an inlet line 60 leading to the coil and outlet line 62 leading therefrom. The cooling medium is shown schematically by arrows 64 entering the coil 58 and leaving coil 58 as at arrow 66 and may comprise water. A further oil line 68 connects to the discharge end of coil 54 within the oil cooler 56.

As shown in FIG. 1B, in the prior art, this cooled oil is fed to a series of atomizing nozzles 70 mounted to the inlet end plate 44 of the rotary helical screw compressor 12, via line 68. Line 68 is branched at 68*a* to supply oil to multiple nozzles 70. A multiplicity of nozzles 70 is provided on both the female inlet end and male inlet end of the intermeshed helical screw rotors 36, 37, FIG. 2B. As an example, the prior art by Shaw shows three atomizing nozzles 70 provided for each rotor 36, 37, with approximately equal circumferential spacing, and with all nozzles 70 at approximately the same distance from the rotor centers as defined by the axes of shafts 41, 42 mounting the screw rotors. The nozzles 70 atomize the oil and spray it into the working fluid at suction pressure within the space between the rotor ends and inlet end plate 44.

As further described in the prior art by Shaw, in addition to line 68*a*, there is a further oil supply line 76 which joins line 68 at point 78, and leads to the screw compressor housing or casing 40 and via various lines or passages with the casing 40 (not shown) to points requiring lubrication within the compressor. A bypass line 80 leads from point 82 downstream of point 78 within line 68, and around a check valve 84 where it again joins line 68 at point 78 from which line 76 branches. Within line 80, there is provided an oil pump indicated schematically at 86 which allows the compressor to drive the oil pump via mechanical connection 87 from compressor shaft 42 which is connected to motor M and driven thereby. The prior art further describes pump 86 as optional since the injection of oil through the nozzles 70 occurs at the suction side of the compressor with the oil at near compressor discharge pressure, and which sees the low suction pressure in contrast to the relatively high discharge pressure within the outlet or discharge port passage 50 leading to conduit 26. However, said pump cannot be optional if said pump is also required to provide circulation of the oil entering the compressor casing 40 to points requiring lubrication within the compressor from supply line 76, unless said oil is ultimately injected into the compressor bores 38,39, bearing the helical screw rotors 36, 37. Said oil must be returned to the closed system at the oil separator 14 which operates at near compressor discharge pressures.

As still further described in said prior art by Shaw, atomized injection may take place by means of a plurality of nozzles as at 70' mounted within casing 40 and opening to the bores 38, 39, bearing the helical screw rotors 36, 37. Nozzles 70' are then fed via a line 88 which connects to oil supply line 68 downstream from oil pump 86. The nozzles 70' are located at positions such that the oil injected in atomized form from the nozzles occurs just after the working fluid suction charge is locked in the rotors 36, 37, at a closed thread. It is proposed in said prior art that atomization through nozzles 70' may be highly advantageous when using a compressible working fluid that readily dissolves into the nonworking liquid.

Cooling Method of the Present Invention

As shown in FIG. 1A, the present invention departs from the prior art at points 90 and 91 where lines 68*a* and 88 and nozzles 70 and 70' are eliminated and replaced by a continuation of oil supply line 68, designated 92, leading to a first heat exchange coil 94 within an oil cooler indicated generally as 96. Said oil cooler is optional and serves to further and independently cool the nonworking liquid cooling oil which is to be atomized. The oil cooler 96 carries a second coil 98 through which a cooling medium is circulated by an inlet line 100 leading to coil 98 and outlet line 102 leading therefrom. The cooling medium is shown schematically by arrows 104 entering the coil 98 and leaving coil 98 as at arrow 106 and may comprise water. A further oil line 108 connects to the discharge end of coil 94 within the oil cooler 96, and further connects to the suction side of optional oil booster pump 110. The purpose of oil booster pump 110 is to increase the pressure of the nonworking liquid cooling oil if necessary to improve the atomization of said cooling oil. Dependent upon the characteristics of said cooling oil, the location of oil cooler 96 and oil booster pump 110 may be interchanged. Said booster pump discharges into a further oil line 112 which leads to optional filter 114. Upon exiting said oil filter 114, the oil line may continue as one line or branch into a plurality of oil lines, of which two, 116 and 118, are illustrated in FIG. 2A. Said oil lines 116 and 118 penetrate at points 120 and 122 the suction elbow 124 of line 34. Lines 116 and 118 further lead into the suction space 48 of the compressor 40, terminating at atomization nozzles 126 and 128. Depending upon the application, a single line such as 116 and a single nozzle such as 126 may suffice. Said nozzles are suspended in the suction gas flow stream and directed nearly parallel to said gas flow stream such that a homogeneous mixture of atomized oil droplets is created within said suction space 48. Said nozzles 126 and 128 may be suitably positioned near and above the centerline of rotor shafts 41, 42 to further improve the homogeneity of the mixture. It is the positive creation of said homogeneous mixture of the working fluid and the nonworking liquid cooling oil which comprises the improvement over the prior art. For particular cases, it may prove advantageous for said nozzles 126 and 128 to be positioned outside of the compressor casing 12 at a suitable location within the suction elbow 124, as shown in FIG. 3. Said nozzles may alternatively be mounted in said elbow at a suitable angle such as 45° to the gas flow as at points 127 and 129. Again, in either case, a single line and a single nozzle may suffice.

For gasses which are highly soluble in the working fluid oil, typically refrigerants R12 and R22, it may be advantageous to degas the relatively small cooling oil flow wherein, as shown in FIG. 1B, a line 130 branches from hot oil line 52 which then passes through a heat exchange coil 132 within a means for heating such as the heat exchanger indicated generally at 134. Within the coil 132, the oil is heated to a temperature nearly high enough to liberate large quantities of dissolved gas. Upon exiting the coil 132 through line 136, the oil enters a means for degassing such as pressure vessel 138, where it is further heated by suitable means, such as an electric resistance heater coil shown as 140, to a temperature high enough to liberate large quantities of dissolved gas while the pressure of the oil is maintained as close as possible to the pressure in oil separator 14. This is to limit the pressure decrease and corresponding volume increase of the gas liberated in pressure vessel 138 which typically is directed to the high pressure side of the process at line 28. The gas liberated in pressure vessel 138 exits said vessel through line 142 and typically passes through heat exchange coil 144 contained within a means for cooling such as heat exchanger 134, then through line 146 to the suction of circulating gas compressor 148, which discharges through line 150 and connects to line 28. It will be recognized by those skilled in the art that a means for controlling the pressure or flow of gas within lines 150 or 28 may be required, such a check valve in line 146 or 150 or line 28, or such as a flow control valve or a pressure control valve in lines 150 or 28. The amount of heat added by coil 140 is limited to that required to compensate for the inefficiency of the heat exchanger 134. Within the pressure vessel 138, gas bubbles are formed which rise to the top of the oil surface. The degassed and very hot oil is removed from said pressure vessel through line 152 and directed to a means for cooling such as heat exchanger 134 through heat exchanger coil 154 wherein heat is directed to coil 132 further heating the hot oil leaving the oil separator 14. Upon exiting coil 154, the now cooled and degassed oil is directed through line 156 connecting with line 92 at point 158. In this case of degassing the nonworking liquid, line 92 between points 78 and 158 is also eliminated. If advantageous to the atomization process and the overall compressor performance, the oil is further cooled by a means for cooling such as heat exchanger 96, increased in pressure by pump 110 and filtered by filter 114 prior to atomization in nozzles 126 and 128. For degassing, heat exchanger 96 is no longer optional but required to lower the temperature of the cooling oil to a level near that of the oil in line 68 exiting heat exchanger 56. However, it may be advantageous for the temperature of the oil entering the nozzles 126 and 128 to vary either positively or negatively from that in line 68. If it is desired to degas the entire oil flow in line 52, line 156 can be returned to line 52 by an appropriate valving arrangement and line 92 between points 78 and 158 can be restored.

Figure 4:
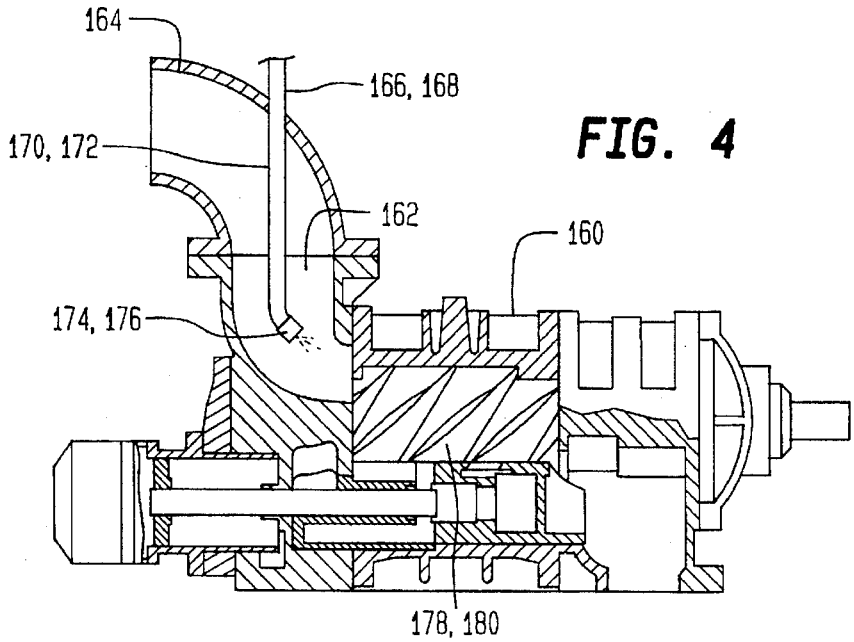
FIG. 4 is a diagram of the preferred embodiment of the present invention with respect to the cooling method showing a helical screw rotary compressor with an alternate suction intake port design conventionally used in the trade.

In FIG. 4, there is illustrated an oil-injected rotary screw compressor with a different casing design commonly used in the trade. The casing 160 differs particularly from that illustrated in FIG. 1 as 12 by the suction port 162 which is a 9° sweep. In this case, the suction elbow 164 is penetrated at points 166 and 168 by the oil supply lines 170 and 172 leading to nozzles 174 and 176. Said nozzles are suspended in the suction gas flow in a parallel direction at approximately a 45° angle again so as to create a homogeneous mixture of oil droplets in the gas flow leading to the rotors 178 and 180. As may be appreciated, said nozzles may also be positioned both within suction elbow 164 or mounted within said elbow in a similar fashion to that illustrated in FIG. 3. Again, depending upon the application, a single oil supply line and a single nozzle may suffice.

Sealing Method of the Present Invention

Figure 5:
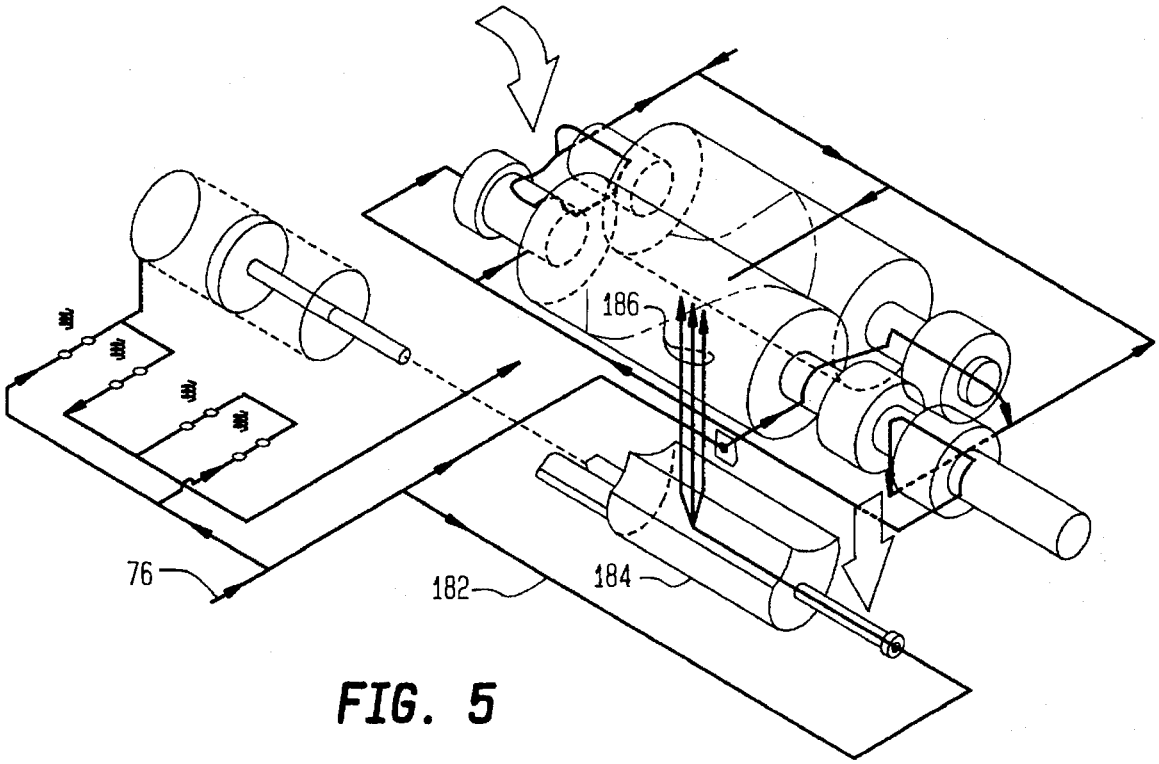
FIG. 5 is a schematic isometric diagram of the rotors and oil distribution system of the type of compressor illustrated in FIG. 4, showing the nonworking liquid oil injected through a capacity control slide valve into the compression space for the dual purpose of cooling and sealing the gas or refrigerant during the compression process, which is typical of the prior art.

With respect to the sealing function, the prior art is further illustrated in FIG. 5, whereby nonworking liquid is injected into the compression space for the dual purpose of cooling and sealing the gas or refrigerant during the compression process. Specifically, from line 76 of FIGS. 1A and 1B, the nonworking liquid oil branches off through line 182 leading to the center of slide valve 184 from which the oil is injected in bulk liquid formthrough holes indicated by arrows 186. In more recent forms of the prior art, to allow for adjustable volume ratios, the oil is not injected through the slide valve 184. Rather, as illustrated in FIG. 6, the oil is injected through a single port 188 located in the compressor casing proximate to the female rotor and downstream from the suction intake approximately one and one-half threads from the suction end. Slide valves are typically used for refrigeration applications where part load operation is desired. For other applications such as air compression, continuous part load operation is not required. In such cases, there is no slide valve and the oil is injected near the suction end of the rotors through a hole in the upper cusp on the male rotor side, illustrated as 190.

As can be inferred from said injection through a single hole in the compressor casing, the sealing function of the oil, whereby the oil must seal the clearances between the tips of the rotors and the compressor casing, is performed in a very crude manner in the prior art. In the prior art by Shaw, no direct sealing function of the nonworking liquid oil is provided since the entire oil injection process consists of atomization. It is the purpose of the present invention to improve upon the prior art by providing direct positive means for sealing the clearances between the rotors and the casing.

In FIG. 7 is illustrated the preferred means to achieve said improvement wherein rotors 178 and 180, shown in plan view within compressor casing 160, each contain a hollow inner cavity, 192 and 194, which is supplied nonworking liquid oil through a suitable port such as through said compressor casing at points 196 and 198. The oil passes through a hole or preferably a plurality of holes in each rotor which are located in the area of the main bearings, shown typically as 200, and which may be perpendicular to the centerline of said rotors. Said holes allow the oil flowing in the bearing area to enter the hollow cavity within the rotors. Alternatively, a hole 202 in the rotor, immediately adjacent to casing hole 198, may be the extreme penetration of the hollow cavity within the rotor and therefore parallel and in alignment with said hollow cavity 192. The foregoing means for supplying oil to a hollow cavity within each rotor is essentially the same means defined in the prior art by Nilsson and Wahlsten. The object of said prior art is to inject and atomize the oil directly into the compression space.

In Grinpress et al, U.S. Pat. No. 3,557,687, instead of injecting and atomizing the oil entering the compression space, oil from the hollow cavities 192 and 194 is injected through holes shown typically as 204 into grooves or channels at the edges of said rotors shown typically as 206. In Grinpress et al., said channels gradually increase in cross section in the direction of flow of the working fluid through the casing and the holes or passages have outlets in the channels which gradually increase in spacing in the direction of flow of the working fluid. The object of Grinpress et al. is to maximize the flow of oil to seal the clearance between the casing and the rotors and also indirectly to seal the interlobe clearance between the male and female rotors upon intermeshing.

Figure 8:
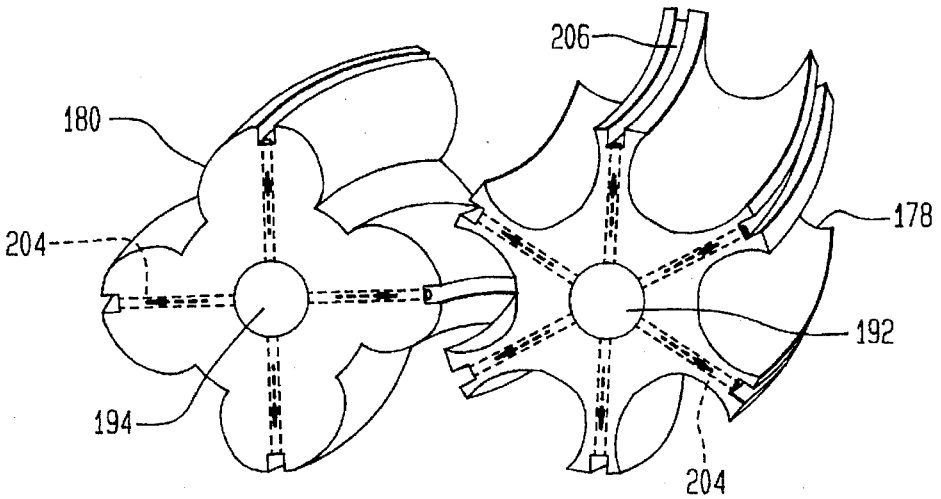
FIG. 8 is an isometric view of the helical screw rotary compressor rotors of the compressor illustrated in FIGS. 4 and 7 showing the preferred embodiments of the present invention with respect to the preferred sealing method.

In the prior art such as Grinpress et al., it was necessary to maximize the flow rate of oil for sealing purposes because only relatively large clearance gaps of the order of 0.1 mm could be manufactured. At the current time, gaps as low as 0.025 mm are commonly achieved. In the present invention, the object is to minimize the flow rate of oil required to seal said clearance between said casing and said rotors and said interlobe clearance. The improvement of the present invention over that of said prior art, as shown in FIG. 8, is that channels 206 are of constant cross section in the direction of flow of the working fluid, i.e. from the suction end of said rotors to the discharge end. Rotors having channels of constant cross section are much simpler to manufacture and allow the flow rate of oil required for sealing purposes to be minimized.

As the nonworking liquid oil is ejected from the holes in the channels directly into the compression pockets of the male and female rotors at the exact point of compression, the oil splashes against the opposite rotor, so that at certain minimum flow rates, the oil flow is atomized, enhancing the cooling effectiveness. The result is a highly effective means of cooling the gas at the exact time of compression with a minimal amount of oil. This process occurs uniformly along the length of the rotors.

Figure 9:
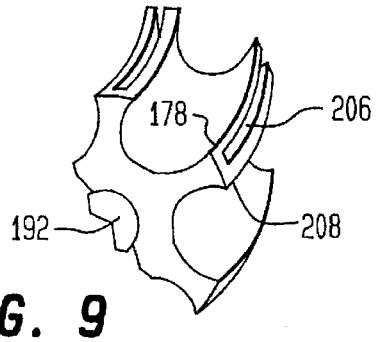
FIG. 9 is an isometric view of a typical rotor of the compressors illustrated in FIGS. 4 and 7 showing the sealing of the extreme ends of the channels in the rotor edges which may be required for the preferred sealing method.
Figure 10:
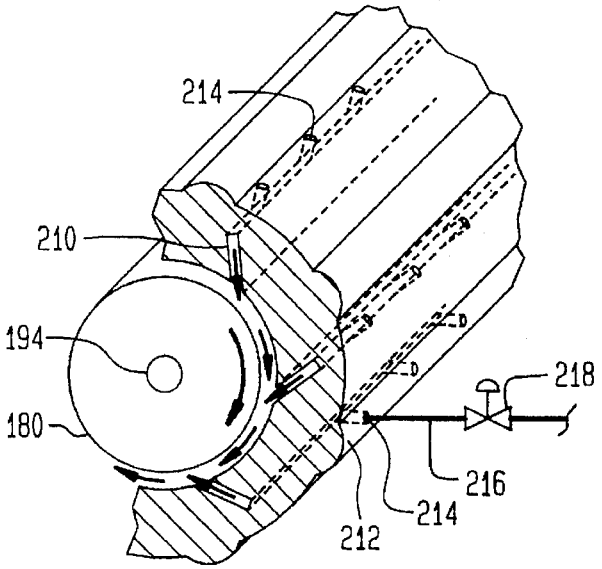
FIG. 10 is an isometric view of the helical screw rotary compressor casing and rotors of the compressor illustrated in FIGS. 4 and 7 showing the preferred embodiments of the present invention with respect to an alternative sealing method of parallel channels in the compressor casing.

In the present invention, said holes 204 may be positioned at suitable locations along the helical path of each rotor such as at intervals forming a 22.5° angle with each other. The entrances of said holes into said channels may be flared to improve the distribution of oil within said channels. Said channels may extend entirely along the length of said rotors, or said channels may only extend only so far as the extreme ends of said rotors so as to prevent the oil from leaving the compressor space and entering the suction and discharge port areas, as shown in FIG. 9 for a female rotor 178 containing a channel 206 which is sealed at the ends as at 208. A similar arrangement applies to a typical male rotor. In FIG. 10 is illustrated an alternative means to provide sealing of the rotor clearances whereby a channel or preferably a set of channels, shown typically as 210, partially penetrates the inner surface of the compressor casing 160 in a direction tangential to the rotor edges. While the direction of flow of nonworking liquid oil from said channels is shown in FIG.

Figure 11:
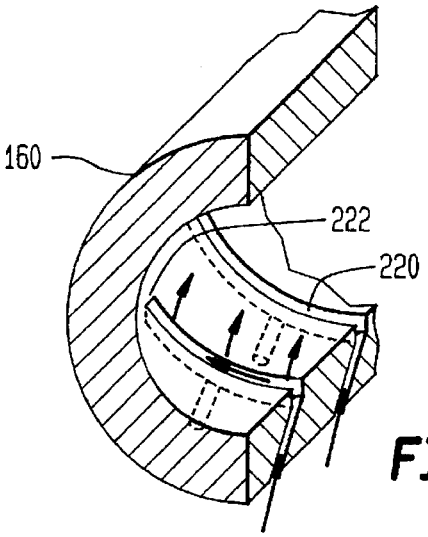
FIG. 11 is an isometric view of the helical screw rotary compressor casing of the compressor illustrated in FIGS. 4 and 7 showing the preferred embodiments of the present invention with respect to a further alternative sealing method of helical channels in the compressor casing.

10 to be in the same direction as rotor rotation, said channels may be oriented such that said flow of nonworking liquid oil from said channels is counter to rotor rotation. Said channels may extend entirely along said compressor casing, except for the areas corresponding to the extreme ends of the rotors as shown in FIG. 11 to be discussed later. The channels extend in a direction parallel to the centerline of rotors 178 and 180. A plurality of said channels may be provided such as three shown for each rotor at a suitable angle such as 90° one to another. To compensate for the reduction in strength of said compressor casing caused by said channels, it may be necessary to increase the overall wall thickness of said casing, or provide reinforcing ribs, shown typically as 212. The holes, shown typically as 214 and which supply the nonworking liquid oil into said channels from the exterior of compressor casing 160, may be drilled at a suitable angle so as to intersect the tips of said channels to provide a uniform flow of oil within said channels and leading to the rotor tips in a tangential direction. The entrances of said holes into said channels may be flared to improve the distribution of oil within said channels. The desired number of holes for each channel depends on the length of rotors. For example, three may be provided at identical positions along each channel: one near the suction end of said rotors, one near the center point of said rotors, and one near the discharge end of said rotors.

As noted by Grinpress, since the pressure and temperature of the working fluid increases toward the discharge end of the rotors, the quantity of nonworking liquid should be increased towards the discharge end. In Grinpress, the grooves communicate with internal passages in the teeth, said passages having outlets in the grooves which gradually decrease in spacing in the direction of flow of the working medium, i.e. from the suction end of the rotors to the discharge end.

In the present invention, the hole diameters for all of the sealing methods described herein typically should be smaller near the suction side of the rotors and casing and gradually increase towards the discharge portion of the rotors. This also can be done in possibly three or four stages or groups of the same hole diameters. The purpose in each case is to restrict the oil flow near the suction side because not as much sealing oil is required due to the lower gas pressure differential and also because of the larger pressure differential between the injection oil and the gas in that area. Conversely, near the discharge area, the gas temperature and pressure have increased significantly so that the tendency for back leakage across the rotor edges or tips increases. Therefore, the oil flow should be increased in this area to counter the higher gas back leakage. Since the pressure differential between the gas and injection oil is significantly reduced near the discharge, the larger holes are required to increase oil flow and minimize oil pressure losses. One skilled in the art may determine optimum hole sizes analytically, or else by trial and error, for compressors of different sizes. Adjustments in oil viscosity through oil temperature changes can help to standardize the final design of the channels and holes for any combination of gas or refrigerant or vapor and oil.

In the present invention, since the spacing of the passages or holes is relatively even from the suction end of the rotors to the discharge end, this allows for improved replenishment of the nonworking liquid which is ejected out of the channels either during the intermeshing of the male and female rotors for the hollow rotor apparatus or during the passage of the rotor compression pocket for the casing injection apparatus. Rapid replenishment of the nonworking liquid in turn provides for more effective sealing of both the rotor to casing clearance and the interlobe clearance.

An alternative means to vary the oil flow rate to the sections of the compressor, illustrated in FIG. 10, is to provide all holes of the same size but each hole being supplied through its individual oil supply line 216 with a manually operated throttling valve 218.

The oil flow may also be supplied to suitable gangs of holes through one throttling valve, i.e. one valve for the gang supplying the suction area, one for the center, and one for the discharge, etc.

In FIG. 11 is illustrated an alternative design of channels 220 such that the paths of said channels within casing 160 correspond to the helical paths of the rotor edges, so as to ensure that the nonworking liquid oil emitted from said channels flows both tangentially and perpendicularly to the rotor edges so as to optimize the sealing effectiveness. While the direction of flow of nonworking liquid oil from said channels is shown in FIG. 11 to be in the same direction as rotor rotation, said channels may be oriented such that said flow of nonworking liquid oil from said channels is counter to rotor rotation. Said channels may be sealed at the ends of said casing, shown typically as 222, corresponding to the extreme suction and discharge ends of the rotors. A similar sealing arrangement is envisioned for the parallel channel design of FIG. 10. In either case, the ends are sealed to contain the oil flow within the rotor space, if required by the particular compressor design. Holes 224 either may increase in diameter from the suction end of the rotors to the discharge end, or may be of the same size with the flow of oil throttled in the same manner as described previously for FIGS. 8 and 10.

Figure 12:
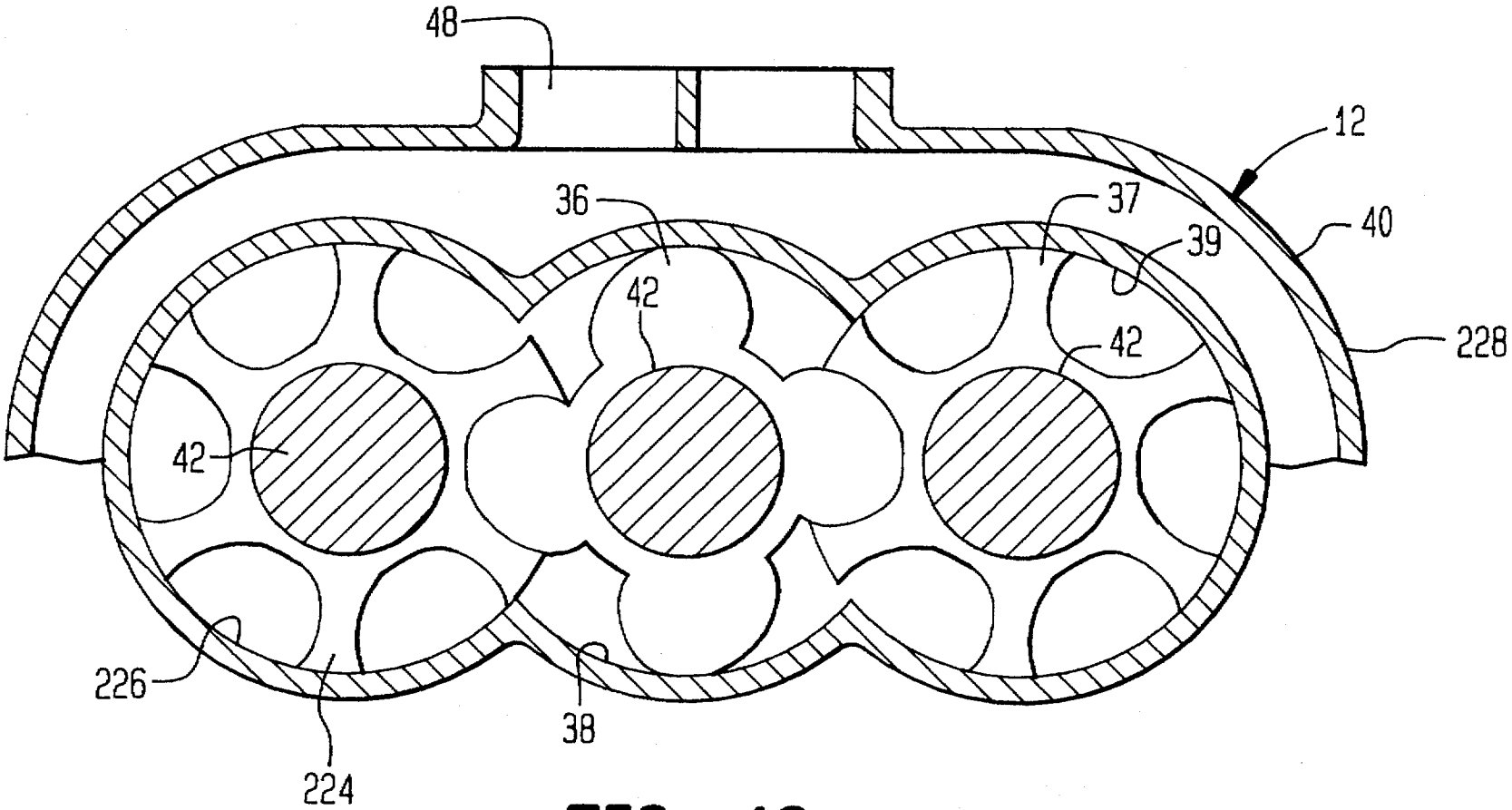
FIG. 12 is a transverse sectional view of the helical screw compressor forming a component of the system of FIG. 1A about lines 12—12 showing the preferred embodiments of the present invention with respect to a plurality of female rotors intermeshing with a central male rotor.

In FIG. 12 is illustrated the preferred embodiment of the present invention comprising an apparatus wherein the clearance space between said casing of said compressor and any tip of any of said rotors is reduced with respect to the volumetric flow rate capacity of the compressor, said apparatus comprising a male rotor central to a plurality of female rotors, said female rotors intermeshing with said male rotor. Compressor casing 40 of compressor 12 of FIG. 2A is expanded to accomodate a plurality of female rotors intermeshing with a central male rotor. Specifically, in FIG. 12, two female rotors 37 and 224 are shown mounted within bores 39 and 226 respectively of compressor casing 228, said female rotors intermeshing with a central male rotor 36 mounted within bore 38 of compressor casing 228. Although two female rotors 39 and 226 are shown, more than two female rotors can be mounted within additional bores of compressor casing 228 to achieve further economy of scale. Furthermore, although FIG. 12 is derived from FIG. 1A which illustrates a helical screw compressor of the type wherein a nonworking liquid enters the compression chamber for the purposes of lubricating the rotors to prevent rotor-to-rotor contact and for sealing the clearance space between the tips of the rotors and the compressor casing and for cooling the working fluid, commonly referred to as the "oil-injected" screw compressor, the arrangement shown in FIG. 12 can be applied as well to helical screw compressors of the type wherein nonworking liquid does not enter the compression chamber. The latter type of helical screw compressor is commonly referred to as a "dry" screw compressor. As for the case of the oil-injected screw compressor, more than two female rotors can be mounted within additional bores of the casing of the dry screw compressor.

While the invention has been particularly shown and described with reference to the preferred embodiments thereof, it will be understood by those skilled in the art that various changes in form and details may be made therein without departing from the spirit and scope of the invention. Furthermore, it will be understood by those skilled in the art that any of the preferred embodiments described herein can be used either jointly with or independently from each other, or jointly with any of the forms of the prior art which may prove advantageous to do so.

What is claimed is:

1. An improved gas or vapor or refrigerant working fluid compression system including a helical screw compressor of the type comprising:

a) a compressor casing said casing having parallel intersecting bores, each of said bores having a longitudinal axis central to said bore;

b) intermeshing helical screw rotors, each of said rotors rotatably mounted within said bores for rotation about said axes and defining within said casing a compression chamber there between, said rotors having tips, said tips and said casing defining a clearance space there between;

c) a low pressure suction port and a high pressure discharge port within said compressor opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

wherein the improvement comprises:

said compressor casing having a channel communicating said nonworking liquid to said clearance space between said casing and any of said tips of said rotors, said channel directing said nonworking liquid in a direction essentially tangential to said tips of said rotors.

2. A method for improving the isothermal or volumetric efficiency of a gas or vapor or refrigerant working fluid compression system, including a helical screw compressor, said compressor of the type comprising:

a) a compressor casing, said casing having parallel intersecting bores, each of said bores having a longitudinal axis central to said bore;

b) intermeshing helical screw rotors, each of said rotors rotatably mounted within said bores for rotation about said axes and defining within said casing a compression chamber therebetween, said rotors having tips, said tips and said casing defining a clearance space therebetween, said tips extending in a helical path along said rotors;

c) a low pressure suction port and a high pressure discharge port, said ports opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

f) means for injecting part of said nonworking liquid at a pressure higher than compression suction pressure into said compression chamber and to said clearance space between said casing and any of said tips of any of said rotors; said method comprising the steps of:

injecting in bulk form said part of said nonworking liquid at a pressure higher than compression suction pressure into said compression chamber and to said clearance space between said casing and any of said tips of said rotors, and atomizing through a nozzle another part of said nonworking liquid at a pressure higher than compression suction pressure, said nozzle directing said atomized nonworking liquid into said gas or vapor or refrigerant working fluid, wherein said nozzle is suspended within said low pressure suction port.

3. The method for improving the isothermal or volumetric efficiency of a gas or vapor or refrigerant working fluid compression system, including a helical screw compressor, as claimed in claim 2, wherein any of said rotors of said compressor further contains an internal passage, said internal passage communicating with said means for supplying a nonworking liquid at a pressure higher than compression suction pressure, any of said tips of said rotors further contains a channel in said helical path of said tip of said rotor, said channel opening to said clearance space, said internal passage communicating with said channel, wherein the step of injecting in bulk form said part of said nonworking liquid at a pressure higher than compression suction pressure into said compression chamber and to said clearance space between said casing and any of said tips of any of said rotors is achieved by injecting said part of said nonworking liquid in bulk form through said internal passage to said channel in said helical path at any of said tips of any of said rotors.

4. The method for improving the isothermal or volumetric efficiency of the gas or vapor or refrigerant compression system, including a helical screw compressor, as claimed in claim 2, wherein said compressor casing further has a channel, said channel opening to any of said bores of said casing, said channel communicating with said means for supplying said nonworking liquid at a pressure higher than compression suction pressure, and wherein the step of injecting in bulk form said part of said nonworking liquid at a pressure higher than compression suction pressure into said compression chamber and to said clearance space between said casing and any of said tips of any of said rotors is achieved by injecting said part of said nonworking liquid in bulk form through said channel in said casing.

5. The method for improving the isothermal or volumetric efficiency of a gas or vapor or refrigerant working fluid compression system, including a helical screw compressor, as claimed in claim 2, wherein said casing of said helical screw compressor further has a valve, said valve providing a means for returning any part of said gas or vapor or refrigerant working fluid from said compression chamber to said low pressure suction port, said valve having a longitudinal axis parallel to said longitudinal axis central to said bores, said valve containing an internal passage, said internal passage communicating with said means for supplying said nonworking liquid at a pressure higher than compression suction pressure, said internal passage opening to any of said bores of said casing, and wherein the step of injecting in bulk form said part of said nonworking liquid at a pressure higher than compression suction pressure into said compression chamber and to said clearance space between said casing and any of said tips of any of said rotors is achieved by injecting said nonworking liquid in bulk form through said internal passage in said valve opening to any of said bores of said casing.

6. The method for improving the isothermal or volumetric efficiency of the gas or vapor or refrigerant compression system, including a helical screw compressor, as claimed in claim 2, wherein said casing of said compressor further contains a hole, said hole opening to any of said bores of said casing, said hole in said casing communicating with said means for supplying said nonworking liquid at a pressure higher than compression suction pressure, and wherein the step of injecting in bulk form said part of said nonworking liquid at a pressure higher than compression suction pressure into said compression chamber and to said clearance space between said casing and any of said tips of any of said rotors is achieved by injecting said nonworking liquid in bulk form through said hole in said casing.

7. A method for improving the isothermal or volumetric efficiency of a gas or vapor or refrigerant working fluid compression system, including a helical screw compressor, said compressor of the type comprising:

a) a compressor casing, said casing having parallel intersecting bores, each of said bores having a longitudinal axis central to said bore;

b) intermeshing helical screw rotors, each of said rotors rotatably mounted within said bores for rotation about said axes and defining within said casing a compression chamber therebetween, said rotors having tips, said tips and said casing defining a clearance space therebetween, said tips extending in a helical path along said rotors;

c) a low pressure suction port and a high pressure discharge port, said ports opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

f) means for injecting part of said nonworking liquid at a pressure higher than compression suction pressure into said compression chamber and to said clearance space between said casing and any of said tips of any of said rotors; said method comprising the steps of:

injecting in bulk form said part of said nonworking liquid at a pressure higher than compression suction pressure into said compression chamber and to said clearance space between said casing and any of said tips of any of said rotors; and atomizing through a nozzle another part of said nonworking liquid at a pressure higher than compression suction pressure, said nozzle directing said atomized nonworking liquid into said gas or vapor or refrigerant working fluid, wherein said nozzle is suspended within said means for feeding a gas or vapor or refrigerant working fluid to said low pressure suction port.

8. The method for improving the isothermal or volumetric efficiency of a gas or vapor or refrigerant working fluid compression system, including a helical screw compressor, as claimed in claim 7, wherein any of said rotors of said compressor further contains an internal passage, said internal passage communicating with said means for supplying a nonworking liquid at a pressure higher than compression suction pressure, any of said tips of said rotors further contains a channel in said helical path of said tip of said rotor, said channel opening to said clearance space, said internal passage communicating with said channel, wherein the step of injecting in bulk form said part of said nonworking liquid at a pressure higher than compression suction pressure into said compression chamber and to said clearance space between said casing and any of said tips of any of said rotors is achieved by injecting said part of said nonworking liquid in bulk form through said internal passage to said channel in said helical path at any of said tips of any of said rotors.

9. The method for improving the isothermal or volumetric efficiency of the gas or vapor or refrigerant compression system, including a helical screw compressor, as claimed in claim 7, wherein said compressor casing further has a channel, said channel opening to any of said bores of said casing, said channel communicating with said means for supplying said nonworking liquid at a pressure higher than compression suction pressure, and wherein the step of injecting in bulk form said part of said nonworking liquid at a pressure higher than compression suction pressure into said compression chamber and to said clearance space between said casing and any of said tips of any of said rotors is achieved by injecting said part of said nonworking liquid in bulk form through said channel in said casing.

10. The method for improving the isothermal or volumetric efficiency of a gas or vapor or refrigerant working fluid compression system, including a helical screw compressor, as claimed in claim 7, wherein said casing of said helical screw compressor further has a valve, said valve providing a means for returning any part of said gas or vapor or refrigerant working fluid from said compression chamber to said low pressure suction port, said valve having a longitudinal axis parallel to said longitudinal axis central to said bores, said valve containing an internal passage, said internal passage communicating with said means for supplying said nonworking liquid at a pressure higher than compression suction pressure, said internal passage opening to any of said bores of said casing, and wherein the step of injecting in bulk form said part of said nonworking liquid at a pressure higher than compression suction pressure into said compression chamber and to said clearance space between said casing and any of said tips of any of said rotors is achieved by injecting said nonworking liquid in bulk form through said internal passage in said valve opening to any of said bores of said casing.

11. The method for improving the isothermal or volumetric efficiency of the gas or vapor or refrigerant compression system, including a helical screw compressor, as claimed in claim 7, wherein said casing of said compressor further contains a hole, said hole opening to any of said bores of said casing, said hole in said casing communicating with said means for supplying said nonworking liquid at a pressure higher than compression suction pressure, and wherein the step of injecting in bulk form said part of said nonworking liquid at a pressure higher than compression suction pressure into said compression chamber and to said clearance space between said casing and any of said tips of any of said rotors is achieved by injecting said nonworking liquid in bulk form through said hole in said casing.

12. A method for improving the isothermal or volumetric efficiency of a gas or vapor or refrigerant working fluid compression system, including a helical screw compressor, said compressor of the type comprising:

a) a compressor casing, said casing having parallel intersecting bores, each of said bores having a longitudinal axis central to said bore;

b) intermeshing helical screw rotors, each of said rotors rotatably mounted within said bores for rotation about said axes and defining within said casing a compression chamber therebetween, said rotors having tips, said tips and said casing defining a clearance space therebetween, said tips extending in a helical path along said rotors;

c) a low pressure suction port and a high pressure discharge port, said ports opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

f) means for injecting part of said nonworking liquid at a pressure higher than compression suction pressure into said compression chamber and to said clearance space between said casing and any of said tips of any of said rotors; said method comprising the steps of:

injecting in bulk form said part of said nonworking liquid at a pressure higher than compression suction pressure into said compression chamber and to said clearance space between said casing and any of said tips of any of said rotors, and atomizing through a nozzle another part of said nonworking liquid at a pressure higher than compression suction pressure, said nozzle directing said atomized nonworking liquid into said gas or vapor or refrigerant working fluid, wherein said nozzle is carried by said means for feeding a gas or vapor or refrigerant working fluid to said low pressure suction port.

13. The method for improving the isothermal or volumetric efficiency of a gas or vapor or refrigerant working fluid compression system, including a helical screw compressor, as claimed in claim 12, wherein any of said rotors of said compressor further contains an internal passage, said internal passage communicating with said means for supplying a nonworking liquid at a pressure higher than compression suction pressure, any of said tips of said rotors further contains a channel in said helical path of said tip of said rotor, said channel opening to said clearance space, said internal passage communicating with said channel, wherein the step of injecting in bulk form said part of said nonworking liquid at a pressure higher than compression suction pressure into said compression chamber and to said clearance space between said casing and any of said tips of any of said rotors is achieved by injecting said part of said nonworking liquid in bulk form through said internal passage to said channel in said helical path at any of said tips of any of said rotors.

14. The method for improving the isothermal or volumetric efficiency of the gas or vapor or refrigerant compression system, including a helical screw compressor, as claimed in claim 12, wherein said compressor casing further has a channel, said channel opening to any of said bores of said casing, said channel communicating with said means for supplying said nonworking liquid at a pressure higher than compression suction pressure, and wherein the step of injecting in bulk form said part of said nonworking liquid at a pressure higher than compression suction pressure into said compression chamber and to said clearance space between said casing and any of said tips of any of said rotors is achieved by injecting said part of said nonworking liquid in bulk form through said channel in said casing.

15. The method for improving the isothermal or volumetric efficiency of a gas or vapor or refrigerant working fluid compression system, including a helical screw compressor, as claimed in claim 12, wherein said casing of said helical screw compressor further has a valve, said valve providing a means for returning any part of said gas or vapor or refrigerant working fluid from said compression chamber to said low pressure suction port, said valve having a longitudinal axis parallel to said longitudinal axis central to said bores, said valve containing an internal passage, said internal passage communicating with said means for supplying said nonworking liquid at a pressure higher than compression suction pressure, said internal passage opening to any of said bores of said casing, and wherein the step of injecting in bulk form said part of said nonworking liquid at a pressure higher than compression suction pressure into said compression chamber and to said clearance space between said casing and any of said tips of any of said rotors is achieved by injecting said nonworking liquid in bulk form through said internal passage in said valve opening to any of said bores of said casing.

16. The method for improving the isothermal or volumetric efficiency of the gas or vapor or refrigerant compression system, including a helical screw compressor, as claimed in claim 12, wherein said casing of said compressor further contains a hole, said hole opening to any of said bores of said casing, said hole in said casing communicating with said means for supplying said nonworking liquid at a pressure higher than compression suction pressure, and wherein the step of injecting in bulk form said part of said nonworking liquid at a pressure higher than compression suction pressure into said compression chamber and to said clearance space between said casing and any of said tips of any of said rotors is achieved by injecting said nonworking liquid in bulk form through said hole in said casing.

17. A method for improving the isothermal or volumetric efficiency of a gas or vapor or refrigerant working fluid compression system including a helical screw compressor of the type comprising:

a) a compressor casing said casing having parallel intersecting bores, each of said bores having a longitudinal axis central to said bore;

b) intermeshing helical screw rotors, each of said rotors rotatably mounted within said bores for rotation about said axes and defining within said casing a compression chamber therebetween, said rotors having tips, said tips and said casing defining a clearance space therebetween;

c) a low pressure suction port and a high pressure discharge port, said ports opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

f) means for separating said gas or vapor or refrigerant working fluid and said nonworking liquid, said means for separating said gas or vapor or refrigerant working fluid and said nonworking liquid communicating with said high pressure discharge port of said compressor, said means for separating said gas or vapor or refrigerant working fluid and said nonworking liquid having a means for discharging said gas or vapor or refrigerant working fluid, said means for separating said gas or vapor or refrigerant working fluid and said nonworking liquid having a means for discharging said nonworking liquid, said method comprising the steps of:

directing a part of said nonworking liquid to a pressure vessel, said part of said nonworking liquid originating from said means for discharging said nonworking liquid from said means for separating said gas or vapor or refrigerant working fluid and said nonworking liquid, and raising the temperature of said part of said nonworking liquid within said pressure vessel, and liberating any portion of gas or vapor or refrigerant working fluid dissolved in said part of nonworking liquid within said pressure vessel, and discharging the now degassed part of said nonworking liquid from said pressure vessel, and cooling said degassed part of said nonworking liquid to a temperature below that of said nonworking liquid within said means for separating said gas or vapor or refrigerant working fluid and said nonworking liquid, and atomizing said degassed part of said nonworking liquid, and directing said degassed part of said nonworking liquid now in atomized form to said low pressure suction port, and discharging said liberated gas or vapor or refrigerant working fluid from said pressure vessel, and directing said liberated gas or vapor or refrigerant working fluid to said means for discharging said gas or vapor or refrigerant working fluid from said means for separating said gas or vapor or refrigerant working fluid and said nonworking liquid.

18. The method for improving the isothermal or volumetric efficiency of the gas or vapor or refrigerant compression system, including a helical screw compressor, as claimed in claim 17, wherein said method further comprises the step of:

increasing the pressure of said degassed part of said nonworking liquid discharged from said pressure vessel to a level above that of said nonworking liquid within said means for separating said gas or vapor or refrigerant working fluid and said nonworking liquid.

19. The method for improving the isothermal or volumetric efficiency of the gas or vapor or refrigerant compression system, including a helical screw compressor, as claimed in claim 17, wherein said method further comprises the step of:

compressing said liberated gas or vapor or refrigerant working fluid directed to said means for discharging said gas or vapor or refrigerant from said means for separating said gas or vapor or refrigerant working fluid and said nonworking liquid.

20. The method for improving the isothermal or volumetric efficiency of the gas or vapor or refrigerant compression system, including a helical screw compressor, as claimed in claim 17, wherein said method further comprises the step of:

heating said part of said nonworking liquid directed to said pressure vessel by heat exchange with said liberated gas or vapor or refrigerant working fluid discharged from said pressure vessel.

21. The method for improving the isothermal or volumetric efficiency of the gas or vapor or refrigerant compression system, including a helical screw compressor, as claimed in claim 17, wherein said method further comprises the step of:

heating said part of said nonworking liquid directed to said pressure vessel by heat exchange with said degassed part of said nonworking fluid discharged from said pressure vessel.

22. A method for improving the isothermal or volumetric efficiency of a gas or vapor or refrigerant working fluid compression system including a helical screw compressor of the type comprising:

a) a compressor casing said casing having parallel intersecting bores, each of said bores having a longitudinal axis central to said bore;

b) intermeshing helical screw rotors, each of said rotors rotatably mounted within said bores for rotation about said axes and defining within said casing a compression chamber therebetween, said rotors having tips, said tips and said casing defining a clearance space therebetween;

c) a low pressure suction port and a high pressure discharge port, said ports opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

f) means for injecting said nonworking liquid into said compression chamber and to said clearance space between said casing and any tip of any of said rotors;

g) means for separating said gas or vapor or refrigerant working fluid and said nonworking liquid, said means for separating said gas or vapor or refrigerant working fluid and said nonworking liquid operatively connected to said high pressure discharge port of said compressor, said means for separating said gas or vapor or refrigerant working fluid and said nonworking liquid comprising a means for discharging said gas or vapor or refrigerant working fluid, said means for separating said gas or vapor or refrigerant working fluid and said nonworking liquid comprising a means for discharging said nonworking liquid, said method comprising the steps of:

directing a part of said nonworking liquid to a pressure vessel, said nonworking liquid originating from said means for separating said gas or vapor or refrigerant working fluid and said nonworking liquid, and raising the temperature of said part of said nonworking liquid within said pressure vessel, and liberating any portion of gas or vapor or refrigerant working fluid dissolved in said part of nonworking liquid, and discharging the now degassed part of said nonworking liquid from said pressure vessel, and cooling said degassed part of said nonworking liquid to a temperature below that of said nonworking liquid within said means for separating said gas or vapor or refrigerant working fluid and said nonworking liquid, and injecting said degassed part of said nonworking liquid into said compression chamber and to said clearance space between said casing and any tip of any of said rotors through said means for injecting said nonworking liquid into said compression chamber and to said clearance space between said casing and any tip of any of said rotors, and discharging said liberated gas or vapor or refrigerant working fluid from said pressure vessel, and directing said liberated gas or vapor or refrigerant working fluid to said means for discharging said gas or vapor or refrigerant from said means for separating said gas or vapor or refrigerant working fluid and said nonworking liquid.

23. The method for improving the isothermal or volumetric efficiency of the gas or vapor or refrigerant compression system, including a helical screw compressor, as claimed in claim 22, wherein said method further comprises the step of:

increasing the pressure of said degassed part of said nonworking liquid discharged from said pressure vessel to a level above that of said nonworking liquid within said means for separating said gas or vapor or refrigerant working fluid and said nonworking liquid.

24. The method for improving the isothermal or volumetric efficiency of the gas or vapor or refrigerant compression system, including a helical screw compressor, as claimed in claim 22, wherein said method further comprises the step of:

compressing said liberated gas or vapor or refrigerant working fluid directed to said means for discharging said gas or vapor or refrigerant from said means for separating said gas or vapor or refrigerant working fluid and said nonworking liquid.

25. The method for improving the isothermal or volumetric efficiency of the gas or vapor or refrigerant compression system, including a helical screw compressor, as claimed in claim 22, wherein said method further comprises the steps of:

heating said part of said nonworking liquid directed to said pressure vessel by heat exchange with said liberated gas or vapor or refrigerant working fluid discharged from said pressure vessel.

26. The method for improving the isothermal or volumetric efficiency of the gas or vapor or refrigerant compression system, including a helical screw compressor, as claimed in claim 22, wherein said method further comprises the steps of:

heating said part of said nonworking liquid directed to said pressure vessel by heat exchange with said degassed part of said nonworking fluid discharged from said pressure vessel.

27. A method for improving the isothermal or volumetric efficiency of a gas or vapor or refrigerant working fluid compression system, including a helical screw compressor, said compressor of the type comprising:

a) a compressor casing, said casing having parallel intersecting bores, each of said bores having a longitudinal axis central to said bore;

b) intermeshing helical screw rotors, each of said rotors rotatably mounted within said bores for rotation about said axes and defining within said casing a compression chamber therebetween, said rotors having tips, said tips and said casing defining a clearance space therebetween, said tips extending in a helical path along said rotors;

c) a low pressure suction port and a high pressure discharge port, said ports opening to said intermeshing helical screw rotors at opposite ends thereof;

d) means for feeding a gas or vapor or refrigerant working fluid to said suction port for compression within said compression chamber;

e) means for supplying a nonworking liquid at a pressure higher than compression suction pressure;

f) means for injecting part of said nonworking liquid at a pressure higher than compression suction pressure into said compression chamber and to said clearance space between said casing and any of said tips of any of said rotors;

g) said casing of said helical screw compressor having a valve, said valve providing a means for returning any part of said gas or vapor or refrigerant working fluid from said compression chamber to said low pressure suction port, said valve having a longitudinal axis parallel to said longitudinal axis central to said bores, said valve containing an internal passage, said internal passage communicating with said means for supplying said nonworking liquid at a pressure higher than compression suction pressure, said internal passage opening to any of said bores of said casing, said method comprising the steps of:

injecting in bulk form said part of said nonworking liquid at a pressure higher than compression suction pressure into said compression chamber and to said clearance space between said casing and any of said tips of said rotors, by injecting said nonworking liquid in bulk form through said internal passage in said valve opening to any of said bores of said casing, and atomizing through a nozzle another part of said nonworking liquid at a pressure higher than compression suction pressure, said nozzle directing said atomized nonworking liquid into said gas or vapor or refrigerant working fluid, wherein said nozzle is carried by said low pressure suction port.

* * * * *